US012492539B2

(12) United States Patent
Nahum

(10) Patent No.: US 12,492,539 B2
(45) **Date of Patent: *Dec. 9, 2025**

(54) DRAIN PIPE CONNECTOR SYSTEM

(71) Applicant: PHYSICLEAN LTD., Kiryat Gat (IL)

(72) Inventor: Nir Nahum, Even Shmuel (IL)

(73) Assignee: PHYSICLEAN LTD., Kiryat Gat (IL)

( * ) Notice: Subject to any disclaimer, the term of this patent is extended or adjusted under 35 U.S.C. 154(b) by 4 days.

This patent is subject to a terminal disclaimer.

(21) Appl. No.: 18/213,581

(22) Filed: Jun. 23, 2023

(65) Prior Publication Data

US 2024/0026668 A1 Jan. 25, 2024

Related U.S. Application Data

(63) Continuation of application No. 17/371,180, filed on Jul. 9, 2021, now Pat. No. 11,725,374, which is a (Continued)

(51) Int. Cl.

| | |
|---|---|
| ***E03C 1/298*** | (2006.01) |
| ***E03C 1/122*** | (2006.01) |
| ***E03C 1/282*** | (2006.01) |

(52) U.S. Cl.

CPC ..... *E03C 1/298* (2013.01); *E03C 1/1222* (2013.01); *E03C 1/282* (2013.01)

(58) Field of Classification Search

CPC ..... E03C 1/298; E03C 1/1222; E03C 1/282; E03C 1/1225; E03C 1/294; E03C 1/288

(Continued)

(56) References Cited

U.S. PATENT DOCUMENTS 1,164,892 A 12/1915 Townsend
1,708,380 A * 4/1929 Deacon ..... E03C 1/284 137/247.27

(Continued)

FOREIGN PATENT DOCUMENTS

CN 101113601 A 1/2008
CN 100480479 C 4/2009

(Continued)

OTHER PUBLICATIONS

Co-pending U.S. Appl. No. 18/825,306, filed Sep. 5, 2024.

(Continued)

*Primary Examiner* — Lori L Baker
(74) *Attorney, Agent, or Firm* — Momentum IP; Marc Van Dyke

(57) ABSTRACT

A drain pipe connector adapted to be disposed between a drain portal of a plumbing fixture and a sewage pipe. The drain pipe connector includes a first unidirectional valve adapted to be in fluid communication with the drain portal, and a drain trap in connected to the first unidirectional valve and adapted to be connected to the sewage pipe. The first unidirectional valve has a closed operative orientation, in which the first unidirectional valve forms a seal between the drain portal and the drain trap, and an open operative orientation which enables flow of fluid from the drain portal, via the first unidirectional valve, into the drain trap. The first unidirectional valve is normally closed, and when liquid drains into the first unidirectional valve, pressure applied by the liquid transitions the first unidirectional valve from the closed operative orientation to the open operative orientation, thereby enabling the liquid to flow into the drain trap.

20 Claims, 27 Drawing Sheets

Related U.S. Application Data continuation-in-part of application No. PCT/IB2020/050130, filed on Jan. 9, 2020.

(60) Provisional application No. 62/790,028, filed on Jan. 9, 2019.

(58) Field of Classification Search
USPC ..... 4/286, 256.1, 292, 295, 652, 287, 288, 4/290; 210/348; 241/32.5, 46.016
See application file for complete search history.

(56) References Cited

U.S. PATENT DOCUMENTS

| | | | | |
|---|---|---|---|---|
| 1,938,064 | A | 12/1933 | Carmine | |
| 2,317,278 | A * | 4/1943 | Larson | E03F 5/042 137/247.21 |
| 2,758,664 | A | 8/1956 | Koenig | |
| 3,460,561 | A * | 8/1969 | Lomolino | E03C 1/284 137/247.13 |
| 3,526,547 | A * | 9/1970 | Shock | E03C 1/306 4/DIG. 9 |
| 4,574,399 | A * | 3/1986 | Sullivan | E03F 9/00 4/669 |
| 5,184,640 | A * | 2/1993 | Molligan | E03D 11/13 4/300 |
| 5,236,137 | A * | 8/1993 | Coogan | E03C 1/2665 251/327 |
| 5,651,147 | A | 7/1997 | Steele | |
| 6,273,124 | B1 | 8/2001 | Huber | |
| 7,509,978 | B1 | 3/2009 | Currid | |
| 11,725,374 | B2 * | 8/2023 | Nahum | E03C 1/298 4/286 |
| 2005/0178438 | A1 * | 8/2005 | Renner | E03C 1/122 137/247.41 |
| 2010/0192295 | A1 * | 8/2010 | Fima | E03D 13/00 4/679 |
| 2012/0305085 | A1 * | 12/2012 | Aiello | E03C 1/296 137/247.13 |
| 2014/0053923 | A1 * | 2/2014 | Martinelli | E03C 1/298 137/527.8 |
| 2014/0373931 | A1 | 12/2014 | Huber | |
| 2015/0114348 | A1 | 4/2015 | Pursifull | |
| 2016/0230375 | A1 | 8/2016 | McAlpine | |
| 2017/0096806 | A1 | 4/2017 | Salzer | |
| 2017/0121954 | A1 | 5/2017 | Chang | |
| 2017/0122445 | A1 | 5/2017 | Fima | |
| 2017/0248242 | A1 | 8/2017 | Hirotani | |
| 2018/0127963 | A1 | 5/2018 | Breton | |

FOREIGN PATENT DOCUMENTS

| | | | | |
|---|---|---|---|---|
| CN | 102753764 | A | 10/2012 | |
| CN | 102892345 | A | 1/2013 | |
| CN | 107354976 | A | 11/2017 | |
| CN | 107604997 | A | 1/2018 | |
| DE | 4220230 | A1 | 12/1993 | |
| DE | 102009042212 | A1 | 4/2011 | |
| DE | 202011104771 | U1 | 12/2011 | |
| EP | 2561893 | A1 | 2/2013 | |
| GB | 1316098 | A | 5/1973 | |
| GB | 1397705 | A | 6/1975 | |
| KR | 101009474 | B1 | 1/2011 | |
| TW | M484600 | U | 8/2014 | |
| TW | 201716667 | A | 5/2017 | |
| WO | 91/05115 | A1 | 4/1991 | |
| WO | 2011/032543 | A2 | 3/2011 | |
| WO | WO-2020144603 | A1 * | 7/2020 | E03C 1/1222 |

OTHER PUBLICATIONS

International Search Report for PCT/IB2020/050130 dated May 19, 2020.
International Search Report for PCT/IB2023/052538 dated Jun. 27, 2023.
Written Opinion for PCT/IB2020/050130 dated May 19, 2020.
Written Opinion for PCT/IB2023/052538 dated Jun. 27, 2023.

* cited by examiner

DRAIN PIPE CONNECTOR SYSTEM

RELATED APPLICATIONS

The present application is a Continuation in Part (CIP) of PCT Patent Application No. PCT/IB2020/050130, filed Jan. 9, 2020 and entitled DRAIN PIPE CONNECTOR SYSTEM, which gains priority from U.S. Provisional Patent Application No. 62/790,028 filed Jan. 9, 2019 and entitled DRAIN PIPE CONNECTOR. Both PCT Patent Application No. PCT/IB2020/050130 and U.S. Provisional Patent Application No. 62/790,028 are incorporated by reference as if fully set forth herein.

FIELD AND BACKGROUND OF THE INVENTION

The present invention generally relates to drain pipe connectors, and specifically to drain pipe connectors for preventing release of biohazardous substances, such as bacteria and/or aerosol contaminated with bacteria, from a drain trap disposed under a sink drain, into the sink and its surrounding.

In typical plumbing, a drain trap, also known as a siphon, is disposed below or within a plumbing fixture, and is shaped and configured to prevent sewer gases from entering buildings. Typically, the drain trap is formed as a U-shaped bend in the drain pipe. In some applications, such as in refineries, drain traps are also used to prevent hydrocarbons and other dangerous gases from escaping from the disposal system via drain openings.

Due to its shape, a typical drain trap retains a small amount of liquid therein at all times, and particularly after use of the plumbing fixture. This trapped liquid seals the remainder of the drain pipe leading to the sewage, thereby preventing sewer gases from reentering the environment via back-flow through the drain pipe. Essentially all plumbing fixtures, including sinks, bathtubs, and toilets, are equipped with either an internal or external trap.

Prior art FIGS. 1A and 1B show an exemplary conventional drain pipe connector 100, which connects a drain portal 102 disposed in a plumbing fixture 103 such as a sink or bathtub to a drain pipe 104 leading to the sewage. Drain pipe connector 100 includes a first connector ring 105 connecting drain portal 102 to a U-shaped drain trap 106, and a second connector ring 108, connecting the trap 108 drain pipe 104.

Because drain traps are a local low-point in the plumbing, heavy objects, such as jewelry that is inadvertently dropped into the fixture 103, often tend to be captured in drain traps such as drain trap 106. Also hair, sand, and other debris tend to be collected in drain traps, such as trap 106, thus limiting the size of objects that flow through the trap into pipe 104. As such, typical drain traps are designed such that they can be disassembled for removal of objects captured therein, or have another cleaning mechanism.

In addition to capturing debris and objects that inadvertently enter the plumbing, drain traps and drain pipe connectors also encourage the formation of biofilm and the accumulation of bacteria. This is, in part, the result of use of tap water which is not sterile, and due to the fact that sinks are used to wash contaminated objects, for example when people wash their hands after going to the bathroom, or wash dirty dishes. Such biofilm formation is illustrated in FIGS. 1A and 1B as layer 110 disposed at the lower end of trap 106, where the trap bends.

As seen in FIG. 1A, bacteria from the trap 106 may "climb" up the drain pipe, for example by air flow out of the drain trap via the drain portal 102, as indicated by arrow 120. Such backflow of bacteria may contaminate the fixture 103 drained by drain portal 102, and may also contaminate the air, or open space, of the room in which the plumbing fixture 103 is disposed.

The problem of bacteria backflow is further compounded by the fact that water draining from the fixture, via drain portal 102 and into trap 106, impinges upon the biofilm 110 formed in the trap 106, as indicated by arrow 130 in FIG. 1B. The water impinging on the biofilm causes contaminated aerosol from the biofilm 110 to be released into the air in the trap 106, facilitating backflow of such aerosol out of trap 106 via drain portal 102 and into the fixture 103 and the room in which it is disposed, as indicated by arrow 122 in FIG. 1B.

There is thus a need in the art for a system for draining a plumbing fixture, which prevents backflow of bacteria and/or contaminated aerosol out of the drain portal of the pluming fixture, and maintains proper operation of the drain pipe and continuous water flow through the drain system.

SUMMARY OF THE INVENTION

In accordance with an embodiment of the present invention, there is provided a drain system disposed between a drain portal of a plumbing fixture and a sewage system, the drain system including:

- a drain pipe connector including:
  - a first unidirectional valve adapted to be in fluid communication with the drain portal; and
  - a linear pipe segment downstream of the first unidirectional valve;
- a drain trap disposed downstream to, and in fluid communication with, the linear pipe segment, and connected to a sewage pipe leading to the sewage system; and
- a pressure equalizing mechanism permitting flow of gas from a region of the drain pipe connector between the first unidirectional valve and a liquid level within the drain trap, to release super-atmospheric pressure from the region,
- wherein the first unidirectional valve has a closed operative orientation, in which the first unidirectional valve forms a seal between the plumbing fixture and the drain trap, and an open operative orientation which enables flow of fluid from the plumbing fixture, via the first unidirectional valve, into the drain trap,
- wherein the first unidirectional valve is normally closed, and when liquid drains into the first unidirectional valve, pressure applied by the liquid transitions the first unidirectional valve from the closed operative orientation to the open operative orientation, thereby enabling the liquid to flow into the drain trap.

In some embodiments, the pressure equalizing mechanism includes a connector nipple disposed within a wall of the drain pipe connector or of the pressure equalizing mechanism, a first end of the connector nipple being in fluid communication with the region and a second, opposing end of the connector nipple being exposed to an external environment of the drain system, and a biological filter disposed at the second end of the connector nipple, or within the connector nipple, wherein the connector nipple permits flow of gas out of the region to the external environment, and gas exiting the connector nipple is filtered from contaminants by the biological filter.

In some embodiments, the pressure equalizing mechanism includes a pressure equalizing conduit having a first end and a second end, the first end of the pressure equalizing conduit being in fluid communication with the region, wherein the pressure equalizing conduit is adapted to allow gas flow from the first end toward the second end, thereby to release gas pressure from the region.

In some embodiments, the drain trap and the pressure equalizing mechanism are integrally formed.

In some embodiments, the drain system further includes a connector nipple disposed within a wall of the drain pipe connector or within a wall of the pressure equalizing mechanism, a first end of the connector nipple being in fluid communication with the region. In some such embodiments, the connector nipple is disposed within the pressure equalizing mechanism, the connector nipple permitting flow of gas from the region, via the pressure equalizing mechanism, to the external environment.

In some embodiments, the drain system further includes a biological filter disposed at the second end of the connector nipple, or within the connector nipple, wherein gas exiting the connector nipple is filtered from contaminants by the biological filter.

In some embodiments, the connector nipple is disposed within a wall of the drain pipe connector, and wherein the first end of the pressure equalizing conduit is connected to the connector nipple such that the pressure equalizing conduit is in fluid communication with the region.

In some embodiments, the pressure equalizing conduit includes a second unidirectional valve disposed within the pressure equalizing conduit between the first end and the second end, wherein the second unidirectional valve is configured to allow a unidirectional flow of the gas from the first end toward the second end.

In some embodiments, the pressure equalizing conduit is in fluid communication with the drain trap, at a portion of the drain trap downstream of a liquid accumulation in the drain trap, so as to be in fluid communication with the sewage pipe.

In some embodiments, the pressure equalizing mechanism further includes a cap, sealing the second end of the pressure equalizing conduit, and a portal, in fluid communication with the second end, the portal being in fluid communication with the drain trap, downstream of a liquid accumulation therein, and with the sewage pipe, the portal being adapted to allow fluid flow from the pressure equalizing mechanism toward the sewage pipe, via the portal.

In some embodiments, the pressure equalizing conduit extends through a bore in the linear drain pipe, such that the second end is disposed within the drain trap.

In some embodiments, the drain system further includes a second nipple connector disposed in a wall of the drain trap and in fluid communication with an interior of the drain trap, wherein the second end of the pressure equalizing conduit is connected to the second nipple connector and is in fluid communication with the drain trap via the second nipple connector.

In some embodiments, the drain system further includes a second linear pipe segment disposed downstream of the drain trap between the drain trap and the sewage pipe, wherein the second end of the pressure equalizing conduit is in fluid communication with the second linear pipe segment. In some such embodiments, the pressure equalizing conduit extends through a bore in the second linear pipe segment, such that the second end is disposed within the second linear pipe segment.

In some embodiments, the drain system further includes a second nipple connector disposed in a wall of the second linear pipe segment and in fluid communication with an interior of the second linear pipe segment, wherein the second end of the pressure equalizing conduit is connected to the second nipple connector and is in fluid communication with the second linear pipe segment via the second nipple connector.

In some embodiments, the pressure equalizing conduit extends through a hollow of the drain trap, internally to walls thereof.

In some embodiments, the pressure equalizing conduit extends through a bore in at least one wall of the drain pipe connector.

In some embodiments, the pressure equalizing conduit further includes at least one filter disposed between the first end and the second end.

In some embodiments, the first unidirectional valve is a spring loaded unidirectional valve, including a valve body including a circumferential sealing surface, a compression spring attached to the valve body, and a rod disposed within the compression spring, between a spring seat surface and a sealing disc, wherein in the closed operative orientation, the sealing disc engages the circumferential sealing surface, thereby to prevent passage of fluid through the valve, and wherein, pressure applied to a surface of the sealing disc is adapted to cause the sealing disc, the rod, and the spring seat surface to move, causing compression of the compression spring, thereby to create a distance between the sealing disc and the circumferential sealing surface through which fluid can flow, resulting in the open operative orientation. In some embodiments, when pressure is relieved from the sealing disc, the compression spring decompresses, pushing the spring seat, resulting in motion of the spring seat, the rod, and the sealing disc to close the distance. In some embodiments, liquid draining through the first unidirectional valve applies sufficient pressure to the surface of the sealing disc to cause transitioning of the first unidirectional valve from the closed operative orientation to the open operative orientation.

In some embodiments, the first unidirectional valve is a rotating unidirectional valve, includes a valve body, and a sealing disc, rotatably connected to the valve body, the disc including at least one inclined surface, wherein in the closed operative orientation, the sealing disc engages an inner surface of the valve body, thereby to prevent passage of fluid through the valve, and wherein pressure applied to the inclined surface of the sealing disc is adapted to cause rotation of the sealing disc, thereby to create a space between the sealing disc and the inner surface of the valve body through which fluid can flow, resulting in the open operative orientation. In some embodiments, water draining through the first unidirectional valve is directed by the inclined surface to one side of the sealing disc, such that pressure applied by the water is applied to a single side of the sealing disc and is sufficient to cause rotation of the sealing disc thereby transitioning of the first unidirectional valve from the closed operative orientation to the open operative orientation.

In some embodiments, a first half of the sealing disc is lighter than a second half of the sealing disc, and wherein the inclined surface is directs liquid impinging on the inclined surface to the first half of the sealing disc. In some embodiments, a weight of the second half of the sealing disc is sufficient so that following removal of pressure from the sealing disc, the sealing disc rotates under the gravitational pull of the second half to cause the first unidirectional valve to transition from the open operative orientation to the closed operative orientation.

In some embodiments, the drain system further includes an additional connector nipple disposed in a wall of the drain pipe connector, the additional connector nipple being connectable to at least one of a biofilm treatment device and a liquid treatment device.

In some embodiments, the drain system further includes a biofilm treatment device connected to the additional connector nipple, the biofilm treatment device including a processor, at least one biofilm treatment unit controlled by the processor, and a power source providing power to the processor and the at least one biofilm treatment unit.

In some embodiments, the biofilm treatment device further includes a housing accommodating the processor and the power source, and wherein the at least one biofilm treatment unit is disposed within the drain trap and is connected to the housing by at least one cable extending through the linear pipe segment and the additional connector nipple.

In some embodiments, the at least one biofilm treatment unit includes a vibrator adapted to vibrate liquid within the drain trap so as to inhibit formation of biofilm and/or to break down existing biofilm.

In some embodiments, the at least one biofilm treatment unit includes a liquid circulating pump, adapted to circulate liquid within the drain trap so as to inhibit formation of biofilm.

In some embodiments, the at least one biofilm treatment unit includes a heating unit adapted to heat liquid within the drain trap so as to exterminate biological contaminants within the liquid in the drain trap.

In some embodiments, the at least one biofilm treatment unit includes an ultra-violet light source adapted to illuminate liquid within the drain trap with ultra-violet light so as to exterminate biological contaminants within the liquid in the drain trap. In some embodiments, the drain trap is transparent.

In some embodiments, the at least one biofilm treatment unit includes a plurality of biofilm treatment units. In some embodiments, the plurality of biofilm treatment units are disposed within the drain trap simultaneously. In some other embodiments, only one of the plurality of biofilm treatment units is disposed within the drain trap at any given time, and the biofilm treatment device is adapted for interchanging between different ones of the plurality of biofilm treatment units.

In some embodiments, the drain system further includes a liquid treatment device connected to the additional connector nipple, the liquid treatment device including a processor, a motor controlled by the processor, a treatment liquid pump controlled by the engine and associated with a treatment liquid reservoir, and a power source adapted to provide power to the processor, the motor, and the treatment liquid pump, wherein the liquid treatment device is adapted to pump treatment liquid from the treatment liquid reservoir into the drain trap to treat liquid disposed therein.

In accordance with another embodiment of the present invention, there is provided a kit for installation in a drain system disposed between a drain portal of a plumbing fixture and a sewage system, the kit including:

a drain pipe connector including:

a first unidirectional valve including a valve hollow, adapted to be in fluid communication with the drain portal, and a valve seal; and a linear pipe segment connected to the first unidirectional valve; and a drain trap connectable to the drain pipe connector and to the sewage system, the drain trap having a pressure equalizing mechanism integrated therewith, the pressure equalizing mechanism including a pressure equalizing conduit having a first end and a second end and being adapted to allow fluid flow from the first end toward the second end; and at least one of:

a cap for sealing the second end of the pressure equalizing conduit, such that, when the kit is assembled, fluid flowing from the first end toward the second end is directed to the sewage system; and a first connector nipple disposed within or connectable to a wall of the drain pipe connector, the drain trap, or the pressure equalizing mechanism and having a first end and a second end, the first end being in fluid communication with the linear pipe segment and the second end being in fluid communication with an external environment of the drain pipe connector or of the drain trap, wherein the first unidirectional valve has a closed operative orientation, in which the valve seal separates the valve hollow from the linear pipe segment, and an open operative orientation which enables flow of fluid from the valve hollow, into the linear pipe segment, wherein the first unidirectional valve is adapted to be normally closed, and is adapted so that, when liquid drains into the valve hollow, pressure applied by the liquid is adapted to transition the first unidirectional valve from the closed operative orientation to the open operative orientation, thereby to enable the liquid to flow into the linear pipe segment.

In accordance with a further embodiment of the present invention, there is provided a kit for installation in a drain system disposed between a drain portal of a plumbing fixture and a sewage system and including a drain trap, the kit including:

a drain pipe connector including:

a first unidirectional valve including a valve hollow, adapted to be in fluid communication with the drain portal, and a valve seal; and a linear pipe segment connected to the first unidirectional valve; and a first connector nipple disposed within a wall of the drain pipe connector and having a first end and a second end, the first end being in fluid communication with the linear pipe segment and the second end being in fluid communication with an external environment of the drain pipe connector; and a second connector nipple, connectable to the second end of the first connector nipple by a pressure equalizing conduit, the second connector nipple adapted to be installed in a wall of the drain trap, downstream of a liquid accumulating portion thereof, wherein the first unidirectional valve has a closed operative orientation, in which the valve seal separates the valve hollow from the linear pipe segment, and an open operative orientation which enables flow of fluid from the valve hollow, into the linear pipe segment, wherein the first unidirectional valve is adapted to be normally closed, and is adapted so that, when liquid drains into the valve hollow, pressure applied by the liquid is adapted to transition the first unidirectional valve from the closed operative orientation to the open operative orientation, thereby to enable the liquid to flow into the linear pipe segment.

In accordance with yet another embodiment of the present invention, there is provided a kit for installation in a drain system disposed between a drain portal of a plumbing fixture and a sewage system and including a drain trap, the kit including:

a drain pipe connector including:

a first unidirectional valve including a valve hollow, adapted to be in fluid communication with the drain portal, and a valve seal; and a linear pipe segment connected to the first unidirectional valve; and a first connector nipple disposed within a wall of the drain pipe connector and having a first end and a second end, the first end being in fluid communication with the linear pipe segment and the second end being in fluid communication with an external environment of the drain pipe connector; and a second linear pipe segment, adapted to be installed between the drain trap and the sewage system, the linear pipe segment having a second connector nipple disposed in a wall thereof, the second connector nipple being connectable to the second end of the first connector nipple by a pressure equalizing conduit, wherein the pressure equalizing conduit is adapted, when the kit is installed and the pressure equalizing conduit connects the first and second connector nipples, to equalize pressure between the first linear pipe segment and the second linear pipe segment, wherein the first unidirectional valve has a closed operative orientation, in which the valve seal separates the valve hollow from the linear pipe segment, and an open operative orientation which enables flow of fluid from the valve hollow, into the linear pipe segment, wherein the first unidirectional valve is adapted to be normally closed, and is adapted so that, when liquid drains into the valve hollow, pressure applied by the liquid is adapted to transition the first unidirectional valve from the closed operative orientation to the open operative orientation, thereby to enable the liquid to flow into the linear pipe segment.

In some embodiments, the kit further includes the pressure equalizing conduit. In some embodiments, the kit further includes at least one of a biological filter and a second unidirectional valve disposed within the pressure equalizing conduit.

In some embodiments, the first unidirectional valve is a spring loaded unidirectional valve, including a valve body defining the valve hollow and including a circumferential sealing surface, a compression spring attached to the valve body, and a rod disposed within the compression spring, between a spring seat surface and a sealing disc forming the valve seal, wherein in the closed operative orientation, the sealing disc engages the circumferential sealing surface, thereby to prevent passage of fluid through the valve, and wherein, pressure applied to a surface of the sealing disc is adapted to cause the sealing disc, the rod, and the spring seat surface to move, causing compression of the compression spring, thereby to create a distance between the sealing disc and the circumferential sealing surface through which fluid can flow, resulting in the open operative orientation.

In some embodiments, when pressure is relieved from the sealing disc, the compression spring decompresses, pushing the spring seat, resulting in motion of the spring seat, the rod, and the sealing disc to close the distance.

In some embodiments, the first unidirectional valve is a rotating unidirectional valve, including a valve body defining the valve hollow and a sealing disc forming the valve seal, the sealing disc being rotatably connected to the valve body and including at least one inclined surface, wherein in the closed operative orientation, the sealing disc engages an inner surface of the valve body, thereby to prevent passage of fluid through the valve, and wherein pressure applied to the inclined surface of the sealing disc is adapted to cause rotation of the sealing disc, thereby to create a space between the sealing disc and the inner surface of the valve body through which fluid can flow, resulting in the open operative orientation.

In some embodiments, a first half of the sealing disc is lighter than a second half of the sealing disc, and wherein the inclined surface is directs liquid impinging on the inclined surface to the first half of the sealing disc. In some embodiments, a weight of the second half of the sealing disc is sufficient so that following removal of pressure from the sealing disc, the sealing disc rotates under the gravitational pull of the second half to cause the first unidirectional valve to transition from the open operative orientation to the closed operative orientation.

In some embodiments, the kit further includes an additional connector nipple disposed in a wall of the drain pipe connector, the additional connector nipple being connectable to at least one of a biofilm treatment device and a liquid treatment device.

In some embodiments, the kit further includes a biofilm treatment device, connectable, or being connected to, the additional connector nipple, the biofilm treatment device including a processor, at least one biofilm treatment unit controlled by the processor, and a power source providing power to the processor and the at least one biofilm treatment unit.

In some embodiments, the biofilm treatment device further includes a housing accommodating the processor and the power source, and wherein the at least one biofilm treatment unit is adapted disposed within the drain trap and is adapted to be connected to the housing by at least one cable adapted to extend through the linear pipe segment and the additional connector nipple. In some embodiments, the at least one biofilm treatment unit includes a vibrator adapted to vibrate liquid within the drain trap. In some embodiments, the at least one biofilm treatment unit includes a liquid circulating pump, adapted to circulate liquid within the drain trap. In some embodiments, the at least one biofilm treatment unit includes a heating unit adapted to heat liquid within the drain trap. In some embodiments, the at least one biofilm treatment unit includes an ultra-violet light source adapted to illuminate liquid within the drain trap with ultra-violet light.

In some embodiments, the at least one biofilm treatment unit includes a plurality of biofilm treatment units. In some such embodiments, at least two of the plurality of biofilm treatment units are adapted to be simultaneously connected to the housing. In some other embodiments, the housing is adapted to be connected to a single one of the plurality of biofilm treatment units at any given time, and is adapted for interchangeable connection to the plurality of biofilm treatment units.

In some embodiments, the kit further includes a liquid treatment device connected to the additional connector nipple, the liquid treatment device including a processor, a motor controlled by the processor, a treatment liquid pump controlled by the engine and associated with a treatment liquid reservoir, and a power source adapted to provide power to the processor, the motor, and the treatment liquid pump, wherein the liquid treatment device is adapted to pump treatment liquid from the treatment liquid reservoir into the drain trap to treat liquid disposed therein.

In accordance with another embodiment of the present invention, there is provided a method of retrofitting a drain system to reduce or prevent release of biological contaminants therefrom, the drain system being disposed between a drain portal of a plumbing fixture and a sewage system and including a drain trap, the method including:

removing a portion of the drain system disposed between the drain portal of the plumbing fixture and the drain trap;

installing the drain pipe connector of any of the kits disclosed herein, such that the hollow of the unidirectional valve is disposed within the drain portal and is in fluid communication with the plumbing fixture, and the first linear pipe segment is inserted into, or connected to, a first end of the drain trap, upstream of a liquid accumulation therein, wherein the biological filter is adapted to filter gas removed from the drain pipe connector via the first connector nipple, thereby to relieve pressure from the drain pipe connector while preventing contamination of the external environment.

In accordance with a further embodiment of the present invention, there is provided a method of retrofitting a drain system to reduce or prevent release of biological contaminants therefrom, the drain system being disposed between a drain portal of a plumbing fixture and a sewage system and including a drain trap, the method including:

removing a portion of the drain system disposed between the drain portal of the plumbing fixture and the drain trap;

providing the any one of the kits disclosed herein, including the drain pipe connector and the second connector nipple;

installing the drain pipe connector, such that the hollow of the unidirectional valve is disposed within the drain portal and is in fluid communication with the plumbing fixture, and the first linear pipe segment is inserted into, or connected to, a first end of the drain trap, upstream of a liquid accumulation in the drain trap;

installing the second nipple connector in a wall of the drain trap, downstream of the liquid accumulation in the drain trap; and connecting the first nipple connector and the second nipple connector by a connecting conduit allowing fluid flow from the first nipple connector to the second nipple connector.

In accordance with still another embodiment of the present invention, there is provided a method of retrofitting a drain system to reduce or prevent release of biological contaminants therefrom, the drain system being disposed between a drain portal of a plumbing fixture and a sewage system and including a drain trap, the method including:

removing a portion of the drain system disposed between the drain portal of the plumbing fixture and the drain trap;

providing any one of the kits disclosed herein, including the drain pipe connector and the second linear pipe segment;

installing the drain pipe connector, such that the hollow of the unidirectional valve is disposed within the drain portal and is in fluid communication with the plumbing fixture, and the first linear pipe segment is inserted into, or connected to, a first end of the drain trap, upstream of a liquid accumulation in the drain trap;

connecting the second linear pipe segment between the drain trap and the a pipe leading to the sewage system; and connecting the first nipple connector and the second nipple connector by a connecting conduit allowing fluid flow from the first nipple connector to the second nipple connector.

BRIEF DESCRIPTION OF THE FIGURES

The foregoing discussion will be understood more readily from the following detailed description of the invention, when taken in conjunction with the accompanying FIGS. 1-17), in which:

FIG. 2B illustrates the drain pipe connector while water is draining therethrough;

FIG. 5B illustrates the drain pipe connector while water is draining therethrough;

FIG. 6B illustrates the drain pipe connector while water is draining therethrough;

FIG. 7B illustrates the drain pipe connector while water is draining therethrough;

DESCRIPTION OF THE PREFERRED EMBODIMENTS

Figure 1B:
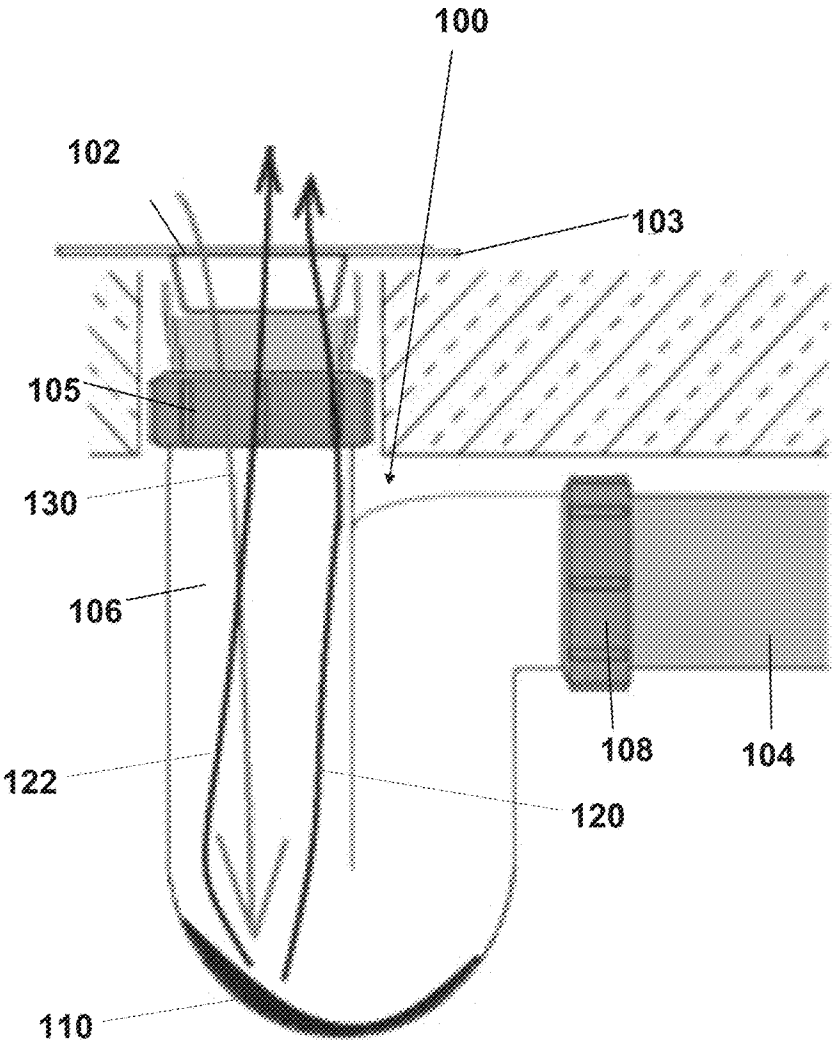
Fig. 1B (Prior art)
FIGS. 1A and 1B (PRIOR ART) are schematic illustrations of a conventional prior art drain pipe connector, including a drain trap.
Figure 1A:
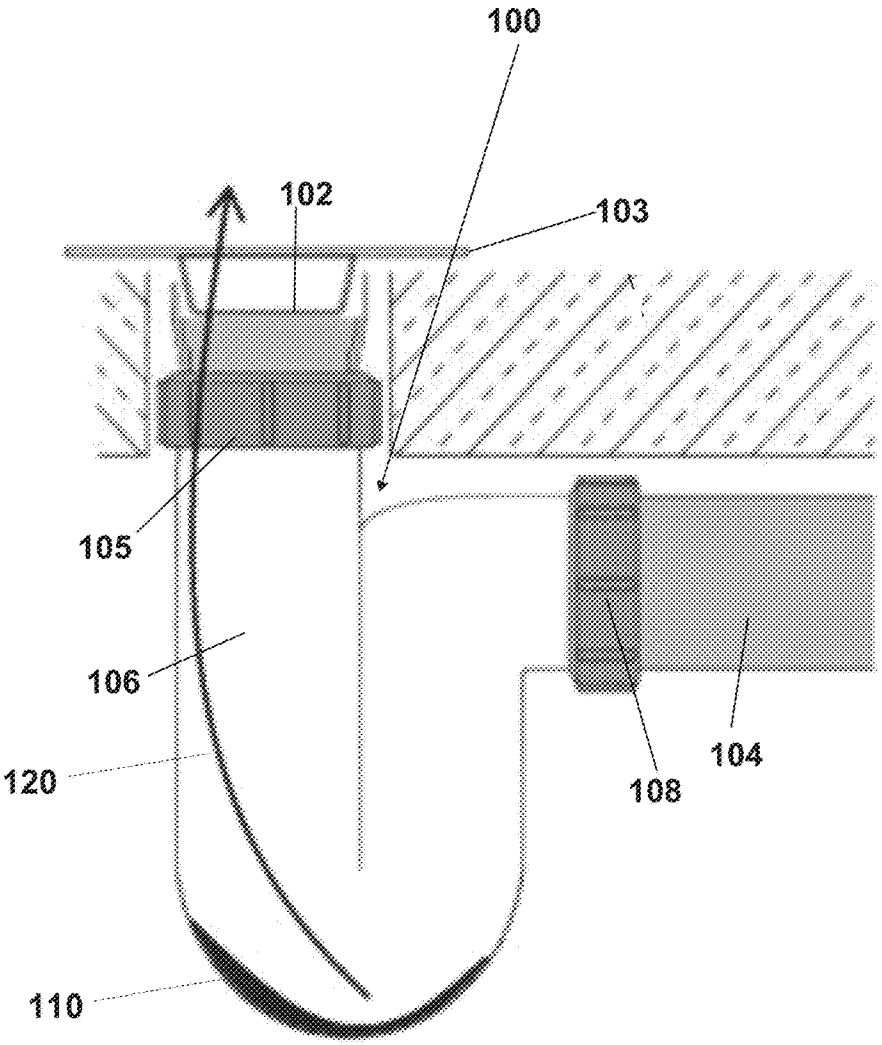
Fig. 1A (Prior art)

The principles of the inventive gastrointestinal treatment system and method of enhancing the absorption into the bloodstream of ingestible medicaments for treating Parkinsonism using the inventive gastrointestinal treatment system, may be better understood with reference to the drawings and the accompanying description.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

In the context of the present application and claims, the term "downstream" relates to a pipe or element, which would be reached by a liquid passing through the drain, at a later time. As such, pipe segment A is downstream of pipe segment B if water draining through the plumbing system would reach pipe segment A after passing through pipe segment B.

In the context of the present application and claims, the term "upstream" relates to a pipe or element, which would be reached by a liquid passing through the drain, at an earlier time. As such, pipe segment A is upstream of pipe segment B if water draining through the plumbing system would reach pipe segment A before passing through pipe segment B.

In some embodiments, the present invention provides a solution to the release of bacteria and/or contaminated aerosol from the biofilm of drain traps to the fixture being drained to the environment of the room in which the fixture is located.

In some embodiments, the present invention includes a unidirectional valve disposed at the drain portal of the plumbing fixture being drained. The unidirectional valve allows water to flow from the fixture into the drainage system, and seals the passage between the fixture and the drain trap when no water is flowing, thereby preventing release of back-flowing bacteria and contaminated aerosol.

In some embodiments, use of such unidirectional valves creates an increased gas pressure within the drain pipe connector, between the drain trap and the fixture. Such increased gas pressure may result in a slow flow of water through the drain pipe. As such, in some embodiments, the present invention further includes a pressure equalizing conduit disposed within the drain pipe connector, which pressure equalizing conduit is adapted to permit gas to flow therethrough in order to relieve the pressure within the drain pipe connector and to allow proper flow of water through the drain pipe connector.

Figure 2A:
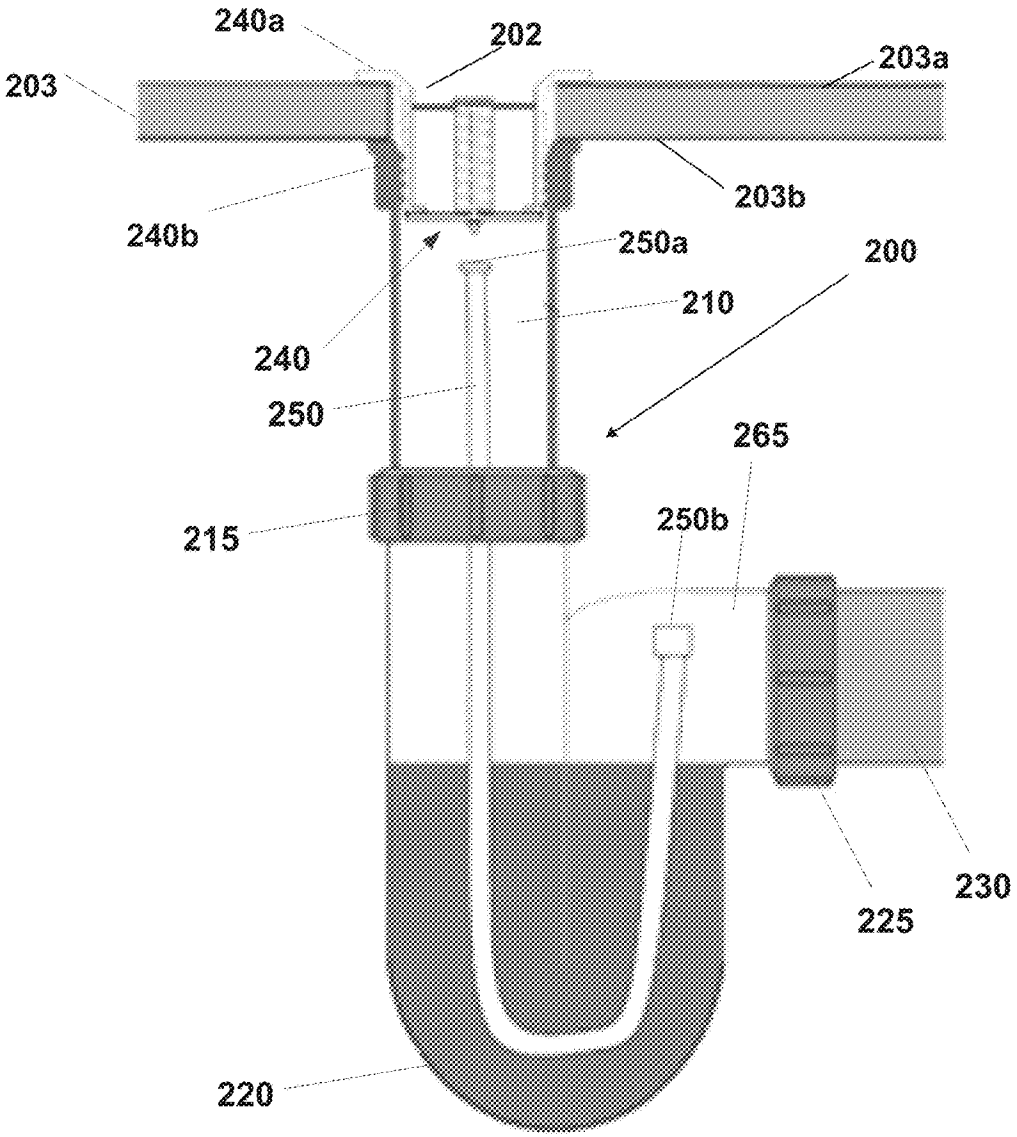
FIGS. 2A and 2B are schematic illustrations of a drain pipe connector including an internal pressure equalizing conduit according to an embodiment of the present invention, where
Figure 2B:
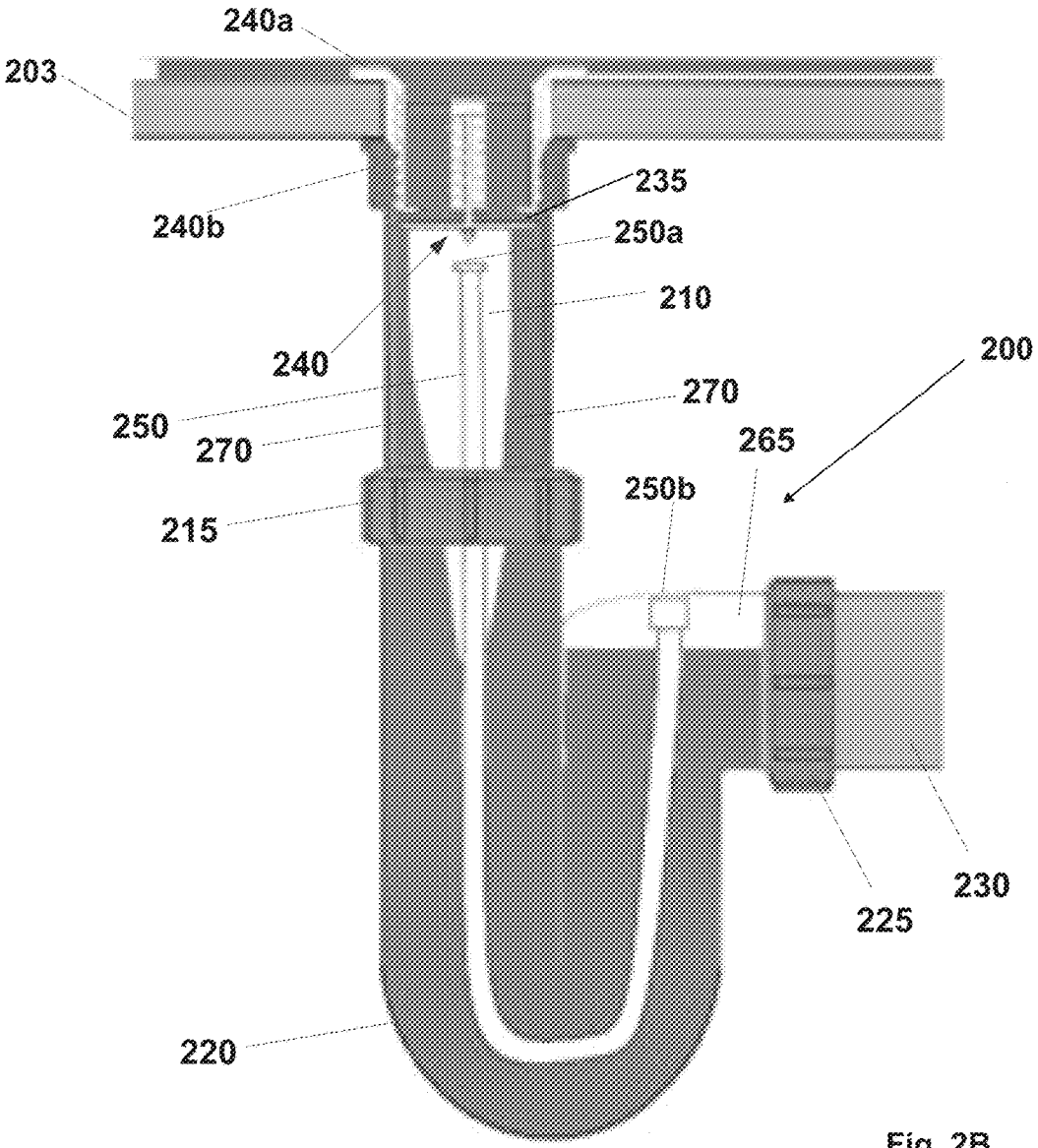

Reference is now made to FIGS. 2A and 2B, which are schematic illustrations of a drain pipe connector 200 including an internal pressure equalizing conduit 250 according to an embodiment of the present invention.

As seen in FIGS. 2A and 2B, drain pipe connector 200 includes a linear pipe segment 210, connected to a drain trap, or siphon, 220 via a first connector 215. Drain trap 220 is connected to a sewage drain pipe 230 via a second connector 225. In some embodiment, first connector 215 and/or second connector 225 may be drain trap nuts as commonly used in the art of plumbing. However, any other suitable connection mechanism is considered to be within the scope of the present invention.

Linear pipe segment 210 is connected to a drain portal 202 of a plumbing fixture 203, such as a sink, via a unidirectional valve 240. Unidirectional valve 240 includes a first body portion 240*a*, mounted onto an upper surface 203*a* of fixture 203, and a second body portion 240*b*, fixedly and/or sealingly connected to first body portion 240*a* and engaging a lower surface 203*b* of fixture 203.

Figure 3A:
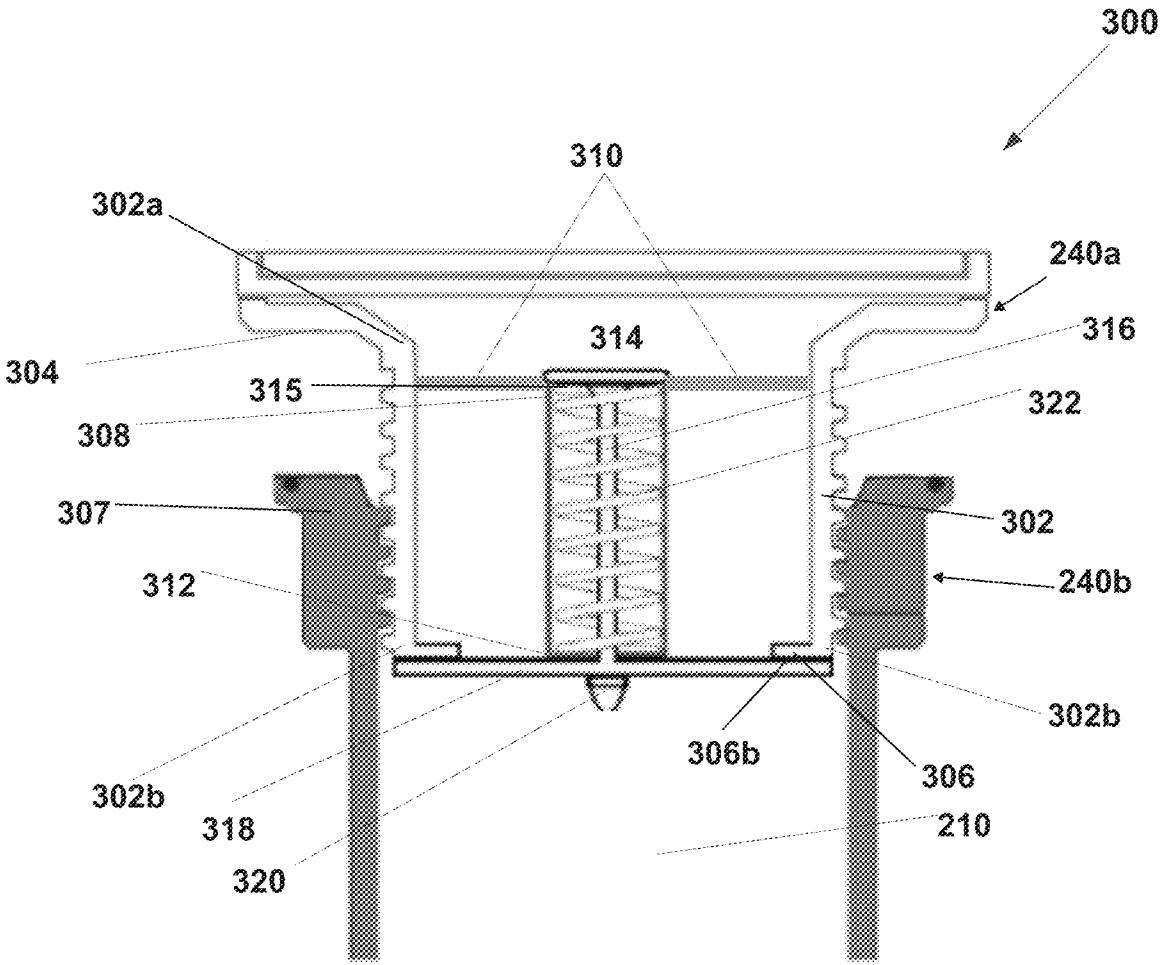
FIGS. 3A and 3B are schematic sectional illustrations of a unidirectional valve forming part of the drain pipe connector of FIGS. 2A and 2B according to an embodiment of the present invention, unidirectional valve shown in a closed operative orientation in FIG. 3A and in an open operative orientation in FIG. 3B.
Figure 3B:
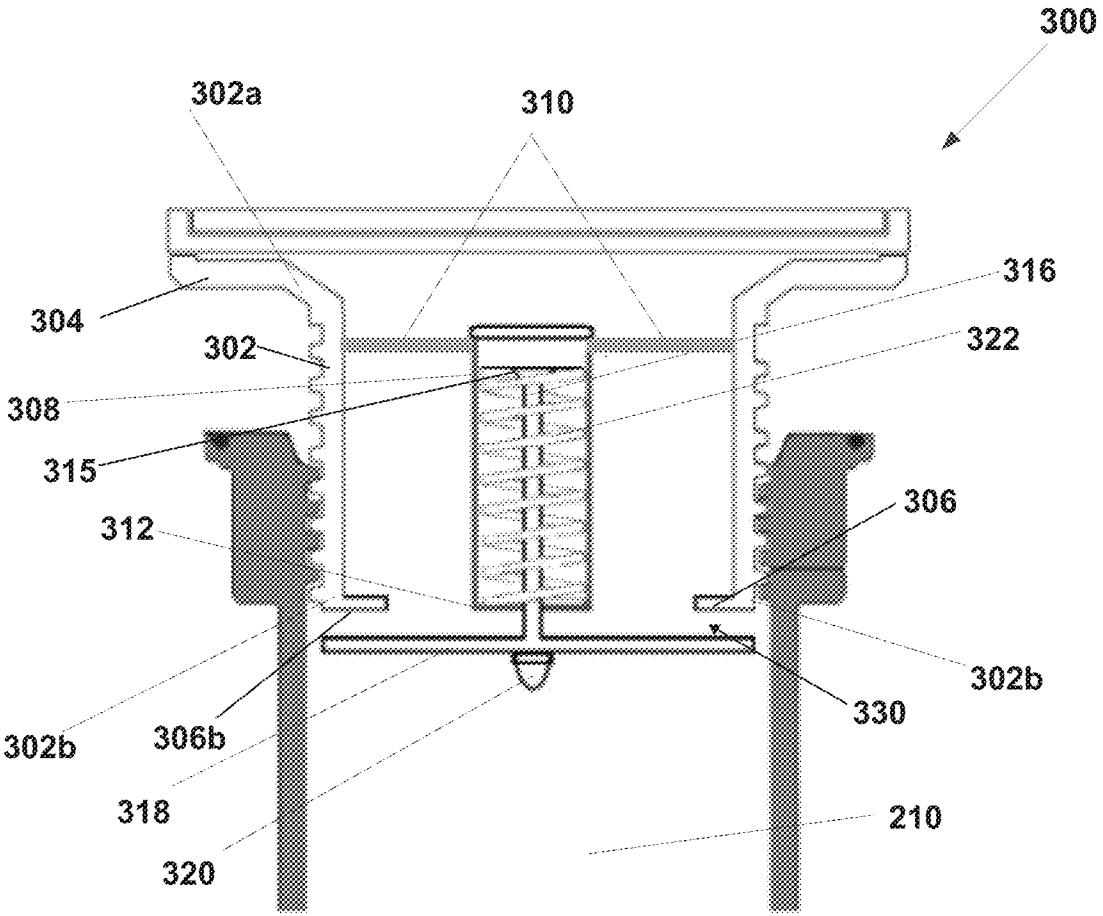

Reference is now additionally made to FIGS. 3A and 3B, which are schematic sectional illustrations of unidirectional valve 240 of FIGS. 2A and 2B. As seen in FIGS. 3A and 3B, first body portion 240*a* of unidirectional valve 240 includes a generally cylindrical body portion 302 having an upper lip 304 extending radially outwardly from an upper end 302*a* thereof. A lower surface 304*b* of upper lip 304 is adapted to engage an upper surface of a plumbing fixture, as shown in FIGS. 2A and 2B. A lower lip 306 extends radially inwardly from a lower end 302*b* of cylindrical body portion 302.

In some embodiments, an exterior surface of cylindrical body portion 302 may be threaded, and may be adapted for threaded engagement with an interior surface of a body portion 307 of second body portion 240*b* of unidirectional valve 240, as explained in further detail hereinbelow. Linear pipe 210 (FIGS. 2A, 2B), extends downwardly from body portion 307 of second body portion 240*b* of unidirectional valve 240.

A hollow cylindrical core 308 is disposed generally at the center of cylindrical body portion 302, and is connected thereto by at least one connector 310. In the illustrated embodiment, core 308 is connected to cylindrical body portion 302 by a pair of connecting rods 310. However, any other suitable connection mechanism, which does not block flow of water into cylindrical body portion 302, is considered to be within the scope of the present invention. Core 308 terminates, at a bottom end thereof, in a radially inward lip 312, and is disposed such that lip 312 is substantially flush with a lower surface 306*b* of lower lip 306.

A first disc 314 is disposed at an upper end of core 308. In some embodiments, first disc 314 may be fixedly attached to the upper end of core 308. In other embodiments, first disc 314 need not be fixed to the core 308, but is sized and configured to remain disposed outside of the cylindrical hollow of core 308, for example by having a diameter equal to or greater than an exterior diameter of core 308. Disposed directly beneath first disc 314 is a first spring seat 315, which is movable relative to disc 314 within core 308, as seen by comparison of FIGS. 3A and 3B. A central rod 316 extends from the center of first spring seat 315 downwardly through core 308 and through a central bore in lip 312 thereof, and is attached at a lower end thereof to a sealing disc 318. In some embodiments, central rod 316 may be fixedly connected to sealing disc 318 by a screw 320. However, any suitable attachment mechanism is considered within the scope of the present invention.

Sealing disc 318 is sized and configured such that when sealing disc 318 engages lip 312 of core 308, an upper surface of the sealing disc engages, and seals against, a lower surface 306*b* of lower lip 306.

A compression spring 322 is disposed within core 308, about central rod 316. Compression spring 322 is seated between first spring seat 315 and lip 312 of core 308. As seen in FIGS. 2A and 3A, compression spring 322 is configured such that when no pressure is applied thereto, for example when no water is draining through the unidirectional valve, sealing disc 318 engages and seals against lower lip 306, thereby preventing back flow of bacterial and/or contaminated aerosol from pipe 210 into fixture 203. As such, the unidirectional valve 240 is normally closed.

When pressure is applied to sealing disc 318, sealing disc 318, together with rod 316 and spring seat 315 move in a downward direction under the pressure, thereby compressing compression spring 322 and creating a gap 330 between sealing disc 318 and lower lip 306, shown in FIG. 3B. As such, as seen in FIG. 2B, when water 270 drains through portal 202 of fixture 203 and into unidirectional valve 240, the weight of the water applies pressure to sealing disc 318, causing compression of spring 322 and opening gap 330, through which the water can flow into linear pipe segment 210.

While water is draining through gap 330, the water flow inhibits air flow through the gap in the opposing direction (out of linear pipe segment 210) and as such during that time back flow of contaminated aerosol and/or bacteria is very limited and/or inhibited.

When water stops draining onto sealing disc 318, compression spring 322 is decompressed and pushes spring seat 315 away from lip 312 of core 308. This motion of spring seat 315 is accompanied by upward motion of rod 316 and sealing disc 318, which are attached to spring seat 315, thus resulting in closing of the gap 330 and resealing of the unidirectional valve.

As mentioned hereinabove, one disadvantage of use of the unidirectional valve 240, is that gas pressure is elevated in linear pipe segment 210, and in drain trap 220 above a liquid level therein. The increased gas pressure within linear pipe segment 210 applies pressure onto the bottom surface of sealing disc 318, making it harder for unidirectional valve 240 to open and limiting water flow through the unidirectional valve.

In order to overcome this disadvantage, and to relieve the gas pressure in pipe segment 210 adjacent unidirectional valve 240, drain pipe connector 200 further includes a pressure equalizing conduit 250, which extends through the pipe segment 210 and the U-shaped bend of drain trap 220. As such, pressure equalizing conduit 250 is considered an internal pressure equalizing conduit. A first end 250*a* of pressure equalizing conduit 250 is disposed within linear pipe segment 210, adjacent unidirectional valve 240 and above the water level of drain trap 220. A second end 250*b* of pressure equalizing conduit 250 is disposed within drain trap 220, at a portion 265 thereof adjacent second connector 225, above the liquid level within the drain trap.

Pressure equalizing conduit 250 serves to equalize the gas pressure between linear pipe segment 210 and portion 265 of drain trap 220, which is fluidly connected to the remainder of sewage pipe 230. Because linear pipe segment 210 has higher gas pressure than atmospheric pressure, in order to equalize gas pressures, gas will flow through pressure equalizing conduit from first end 250*a* to second end 250*b*, and from there to sewage pipe 230, thereby relieving the pressure and enabling proper functioning of unidirectional valve 240. Furthermore, because the bacteria and/or contaminated aerosols that the invention is designed to block are disposed within linear pipe segment 210, the airborne bacteria and/or contaminated aerosol may also flow through pressure equalizing conduit 250 away from portal 202, and be trapped beyond drain trap 220, thereby further preventing the chances of contaminated backflow through portal 202.

Pressure equalizing conduit 250 would not result in backflow of gas from sewage pipe 230 to linear pipe segment 210, due to the higher pressure in linear pipe segment 210.

Figure 4A:
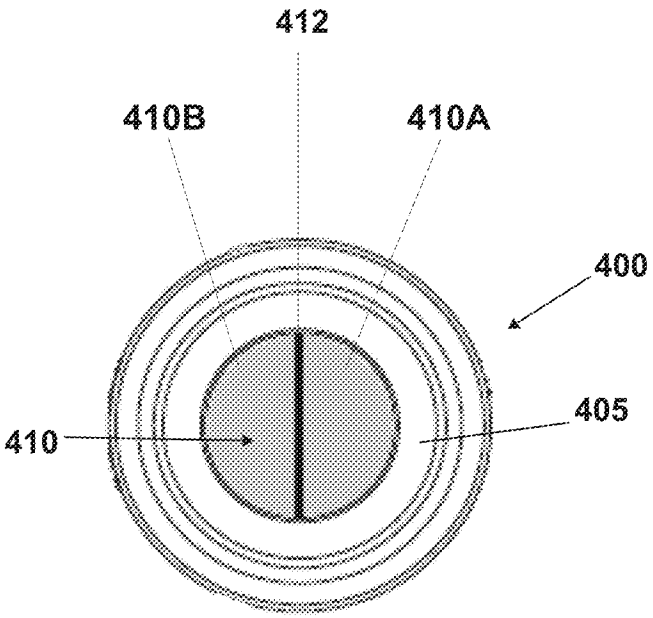
FIGS. 4A and 4B are, respectively, a schematic top view illustration and a schematic side view illustration of a unidirectional valve forming part of the drain pipe connector of FIGS. 2A and 2B according to another embodiment of the present invention, the unidirectional valve shown in a closed operative orientation in FIG. 4A and in an open operative orientation in FIG. 4B.
Figure 4B:
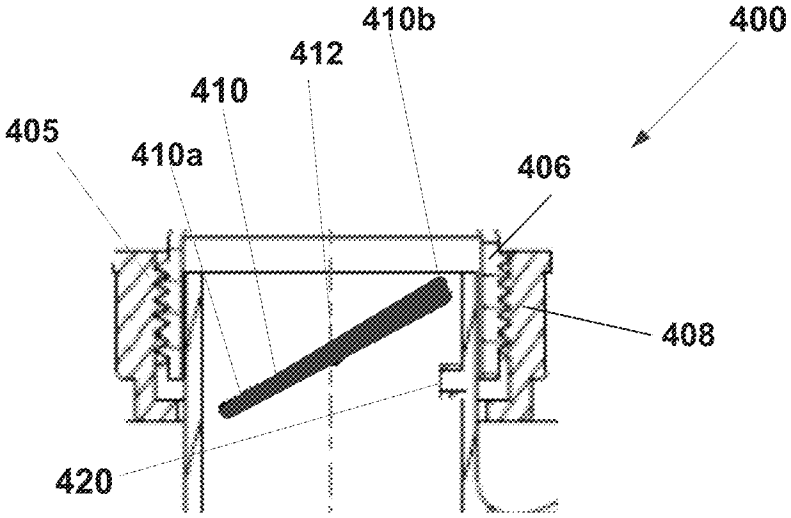

Reference is now made to FIGS. 4A and 4B, which are, respectively, a schematic top view illustration and a schematic side view illustration of another embodiment of a unidirectional valve which may form part of drain pipe connector 200 according to another embodiment of the present invention.

The unidirectional valve 400 of FIGS. 4A and 4B may replace the unidirectional valve 240 illustrated in FIGS. 2A to 3B. Unidirectional valve 400 includes a generally cylindrical valve body 405, which may form part of, or be continuous to, linear pipe segment 210, as illustrated in FIG. 4B. In some embodiments, the valve body 405 is surrounded by a first portion 406, which includes a thread along an external surface thereof, for threaded engagement with a second portion 408.

Unidirectional valve 400 comprises a disc 410, connected to valve body 405 by a hinge 412, such that disc 410 can rotate about hinge 412 relative to valve body 405. As seen clearly in FIG. 4B, an upper surface of disc 410 is inclined. Additionally, the disc has a first weight (thickness) at a first side of hinge 412, here illustrated as side 410*a*, and a second, lighter weight (smaller thickness) at a second side of hinge 412 illustrated as side 410*b*. The difference in weight between sides 410*a* and 410*b* is sufficiently small such that when no pressure is applied to the disc 410, the disc is disposed substantially horizontally relative to the longitudinal axis of valve body 405, and engages the inner surface of the cylindrical valve body 405. As such, the unidirectional valve 400 has a normally closed state, in which back flow from pipe 210 via valve body 405 is blocked.

When water flows through the drain into valve body 405, the inclination of the upper surface of disc 410 causes the water to flow toward side 410*b* of the disc. The pressure applied to side 410*b* of the disc, which is the lighter side, causes the disc to rotate relative to valve body 405, such that side 410*b* is lower and side 410*a* is higher, thereby enabling water to flow around disc 410 into linear pipe segment 210.

When water stops flowing and applying pressure to side 410*b* of the disc, the greater weight of side 410*a* causes the disc to be rotated in the opposing direction. In some embodiments, a stopper 420 protrudes radially inwardly from valve body 405, such that the rotation of the disc due to the weight of side 410*a* is stopped when the disc 410 is substantially perpendicular to the longitudinal axis of valve body 405, and seals against the inner surface of the valve body.

The disc 410 may be formed of any suitable material, such as stainless steel, plastic and the like.

Figure 5A:
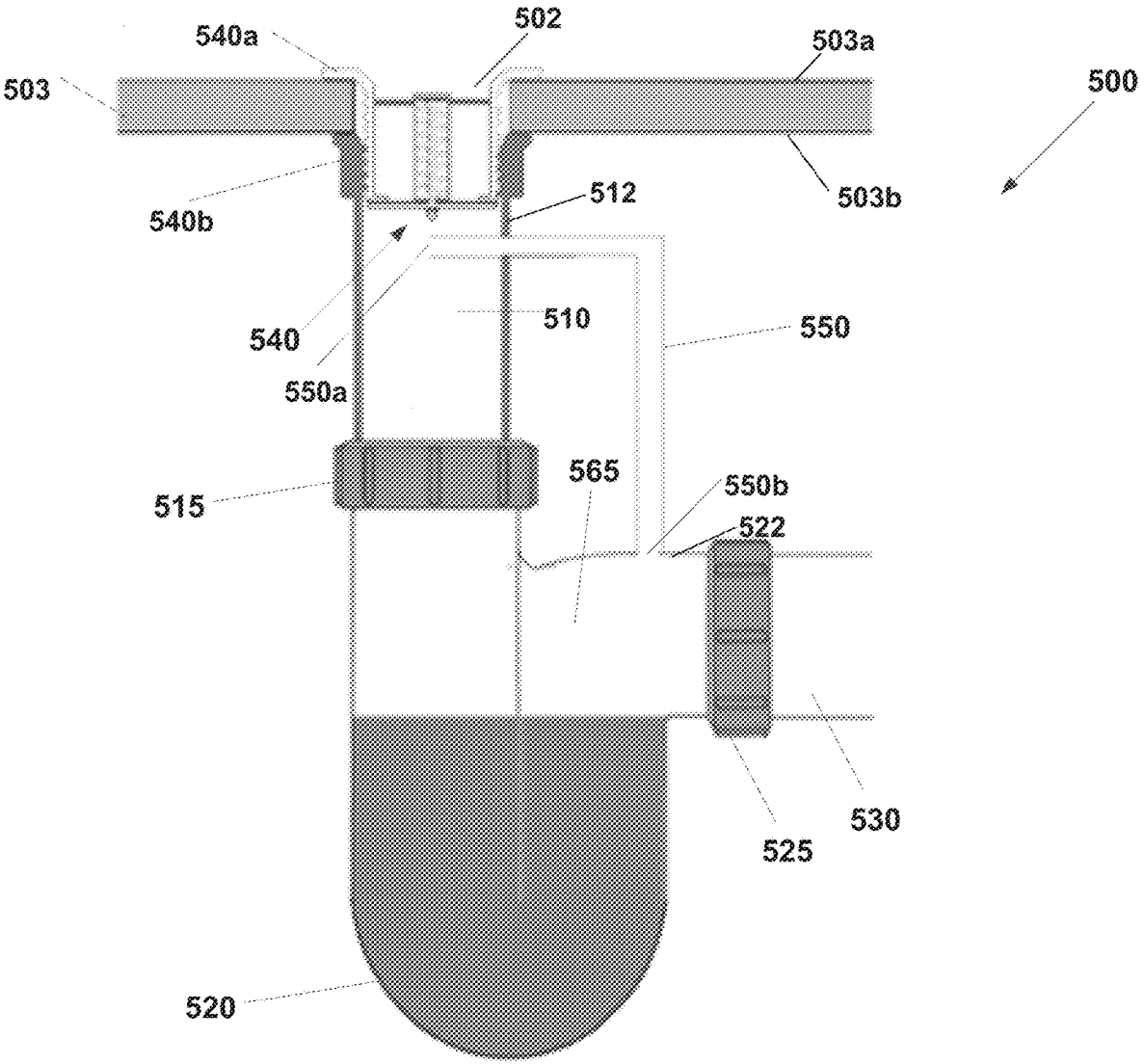
FIGS. 5A and 5B are schematic illustrations of a drain pipe connector including an external pressure equalizing conduit according to another embodiment of the present invention, where
Figure 5B:
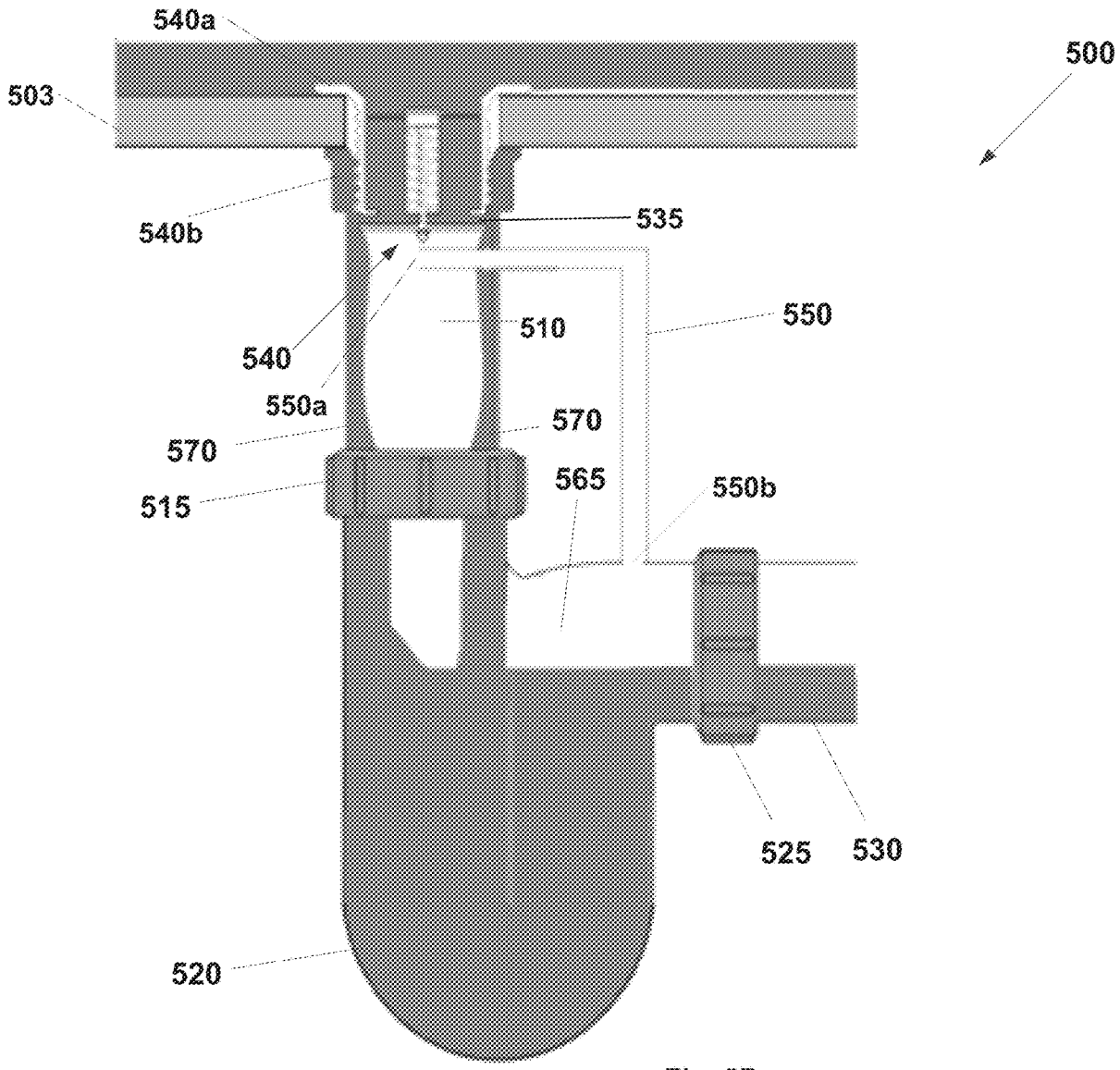

Reference is now made to FIGS. 5A and 5B, which are schematic illustrations of a drain pipe connector 500 including an external pressure equalizing conduit 550 according to another embodiment of the present invention. The drain pipe connector 500 illustrated in FIGS. 5A and 5B is substantially similar to the drain pipe connector 200 of FIGS. 2A and 2B, with the main difference therebetween being the location of the pressure equalizing conduit, as explained herein.

As seen in FIGS. 5A and 5B, drain pipe connector 500 includes a linear pipe segment 510, connected to a drain trap, or siphon, 520 via a first connector 515. Drain trap 520 is connected to a sewage drain pipe 530 via a second connector 525. In some embodiment, first connector 515 and/or second connector 525 may be drain trap nuts as commonly used in the art of plumbing. However, any other suitable connection mechanism is considered to be within the scope of the present invention.

Linear pipe segment 510 is connected to a drain portal 502 of a plumbing fixture 503, such as a sink, via a unidirectional valve 540. Unidirectional valve 540 includes a first body portion 540*a*, mounted onto an upper surface 503*a* of fixture 503, and a second body portion 540*b*, fixedly and/or sealingly connected to first body portion 540*a* and engaging a lower surface 503*b* of fixture 503. In the embodiment illustrated in FIGS. 5A and 5B, the unidirectional valve 540 is equivalent to the unidirectional valve 240 shown in FIGS. 2A to 3B. However, the invention may instead utilize the unidirectional valve of FIGS. 4A to 4B, or any other suitable unidirectional valve which allows running water to flow, and seals the passage between the drain trap and the fixture when no water is flowing.

As discussed hereinabove with respect to FIGS. 3A and 3B and with respect to FIGS. 4A and 4B, the unidirectional valve is normally closed, such that when no water flows into/onto the valve, the valve is sealed to fluid flow into and/or out of drain trap 520 and linear pipe segment 510, thereby preventing back flow of bacterial and/or contaminated aerosol from pipe 510 into fixture 503. As such, the unidirectional valve 540 is normally closed.

When water flows into unidirectional valve 540, it applies pressure thereto which causes the valve to open. As such, as seen in FIG. 5B, when water 570 drains through portal 502 of fixture 503 and into unidirectional valve 540, the weight of the water causes the valve to open a gap 535 through which the water can flow into linear pipe segment 210. The mechanism by which gap 535 is opened is described hereinabove with respect to FIGS. 3A and 3B. While water is draining through gap 535, the water flow inhibits air flow through the gap in the opposing direction (out of linear pipe segment 510) and as such during that time back flow of contaminated aerosol and/or bacteria is very limited and/or inhibited.

The increased pressure in linear pipe segment 510, caused by the use of the unidirectional valve 540, as described hereinabove with respect to FIGS. 2A and 2B, is relieved by a pressure equalizing conduit 550, parts of which extend externally to pipe segment 510 and the U-shaped bend of drain trap 520. As such, pressure equalizing conduit 550 is considered an external pressure equalizing conduit. A first end 550*a* of pressure equalizing conduit 550 is disposed within linear pipe segment 510, adjacent unidirectional valve 540 and above the water level of drain trap 520. From there, the pressure equalizing conduit 550 extends through a portal in a wall 512 of linear pipe segment 510 to an exterior thereof, and through a portal in a wall 522 of drain trap 520, such that a second end 550*b* of pressure equalizing conduit 550 is disposed within drain trap 520, at a portion 565 thereof adjacent second connector 525, above the liquid level within the drain trap.

Pressure equalizing conduit 550 functions in the same manner as internal pressure equalizing conduit 250 described hereinabove with respect to FIGS. 2A and 2B, and serves to equalize the gas pressure between linear pipe segment 510 and portion 565 of drain trap 520, which is fluidly connected to the remainder of sewage pipe 530. As such, due to the pressure differential between linear pipe segment 510 and portion 565 of drain trap 520, gas will flow through the pressure equalizing conduit from first end 550*a* to second end 550*b*, and from there to sewage pipe 530, thereby relieving the pressure and enabling proper functioning of unidirectional valve 540. Furthermore, because the bacteria and/or contaminated aerosols that the invention is designed to block are disposed within linear pipe segment 510, the airborne bacteria and/or contaminated aerosol may also flow through pressure equalizing conduit 550 away from portal 502, and be trapped beyond drain trap 520, thereby further preventing the chances of contaminated backflow through portal 502.

Pressure equalizing conduit 550 would not result in backflow of gas from sewage pipe 530 to linear pipe segment 510, due to the higher pressure in linear pipe segment 510.

Figure 6A:
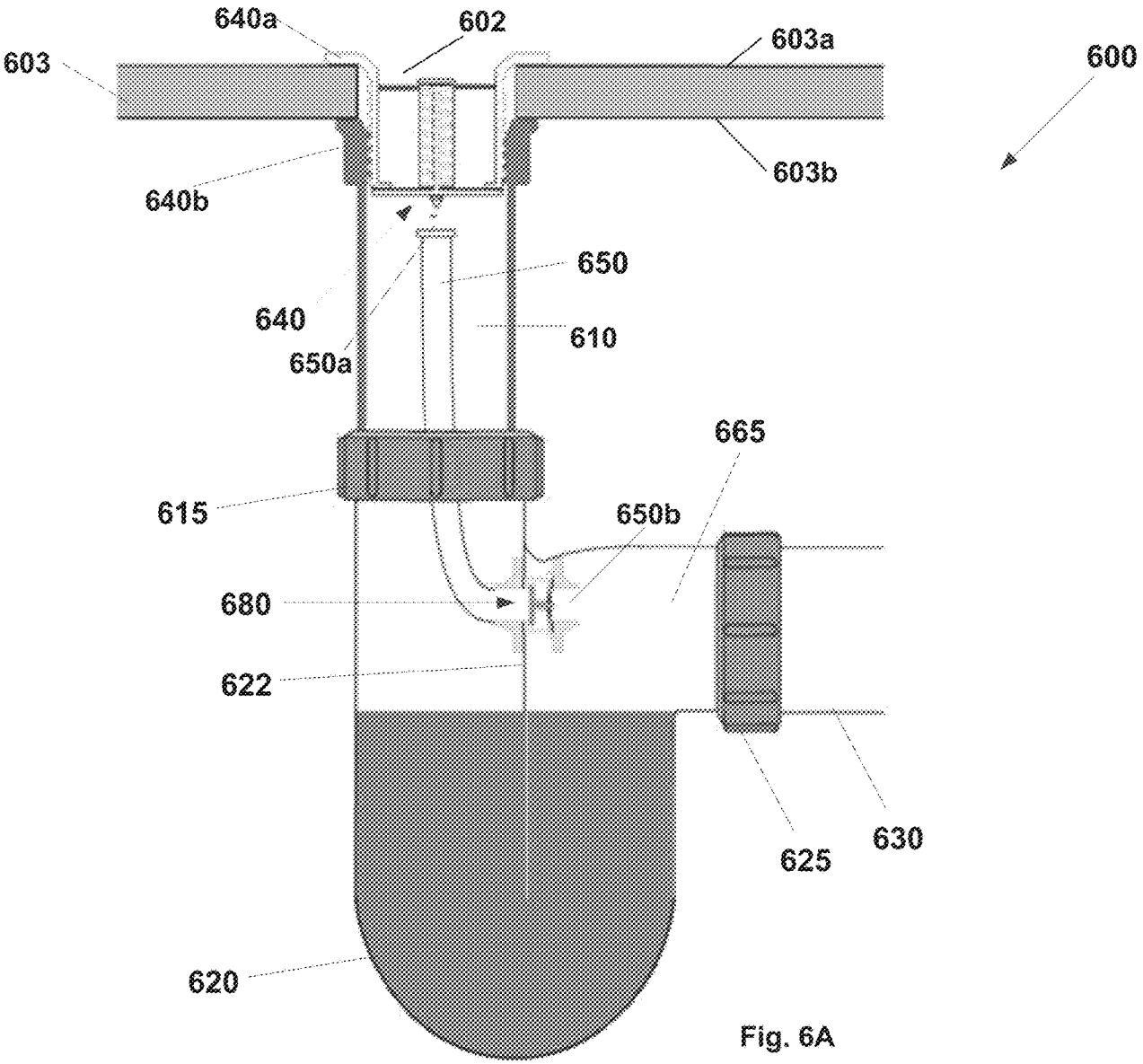
FIGS. 6A and 6B are schematic illustrations of a drain pipe connector including an internal pressure equalizing conduit including a second unidirectional valve according to yet another embodiment of the present invention, where
Figure 6B:
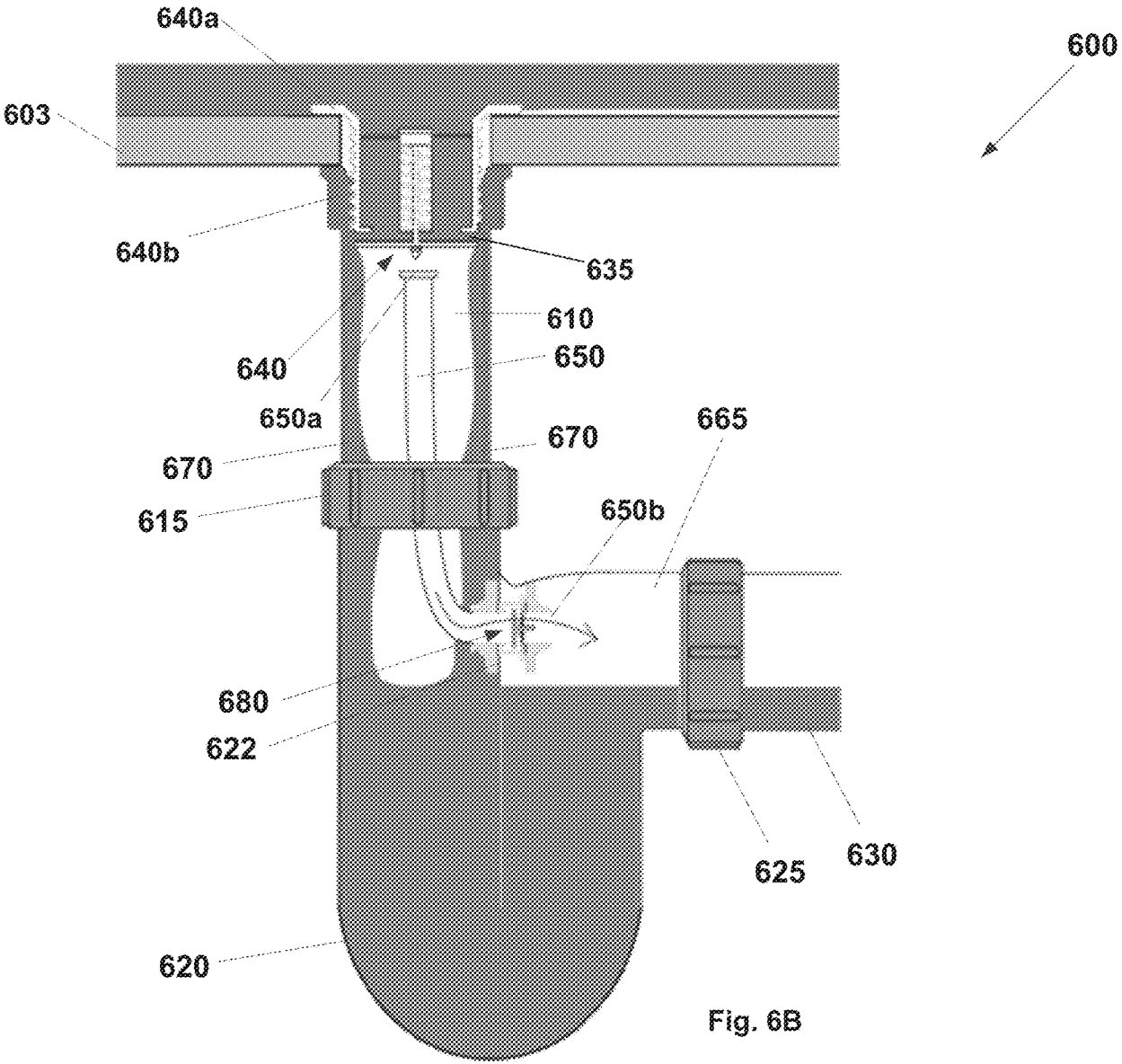

Reference is now made to FIGS. 6A and 6B, which are schematic illustrations of a drain pipe connector 600 including an internal pressure equalizing conduit 650 including a second unidirectional valve 680 according to yet another embodiment of the present invention. The drain pipe connector 600 illustrated in FIGS. 6A and 6B is substantially similar to the drain pipe connector 200 of FIGS. 2A and 2B, with the main difference therebetween being the presence of second unidirectional valve 680 at the trap end of the pressure equalizing conduit, as explained herein.

As seen in FIGS. 6A and 6B, drain pipe connector 600 includes a linear pipe segment 610, connected to a drain trap, or siphon, 620 via a first connector 615. Drain trap 620 is connected to a sewage drain pipe 630 via a second connector 625. In some embodiment, first connector 615 and/or second connector 625 may be drain trap nuts as commonly used in the art of plumbing. However, any other suitable connection mechanism is considered to be within the scope of the present invention.

Linear pipe segment 610 is connected to a drain portal 602 of a plumbing fixture 603, such as a sink, via a unidirectional valve 640. Unidirectional valve 640 includes a first body portion 640*a*, mounted onto an upper surface 603*a* of fixture 603, and a second body portion 640*b*, fixedly and/or sealingly connected to first body portion 640*a* and engaging a lower surface 603*b* of fixture 603. In the embodiment illustrated in FIGS. 6A and 6B, the unidirectional valve 640 is equivalent to the unidirectional valve 240 shown in FIGS. 2A to 3B. However, the invention may instead utilize the unidirectional valve of FIGS. 4A to 4B, or any other suitable unidirectional valve which allows running water to flow, and seals the passage between the drain trap and the fixture when no water is flowing.

As discussed hereinabove with respect to FIGS. 3A and 3B and with respect to FIGS. 4A and 4B, the unidirectional valve is normally closed, such that when no water flows into/onto the valve, the valve is sealed to fluid flow into and/or out of drain trap 620 and linear pipe segment 610, thereby preventing back flow of bacterial and/or contaminated aerosol from pipe 610 into fixture 603. As such, the unidirectional valve 640 is normally closed.

When water flows into unidirectional valve 640, it applies pressure thereto which causes the valve to open. As such, as seen in FIG. 5B, when water 670 drains through portal 602 of fixture 603 and into unidirectional valve 640, the weight of the water causes the valve to open a gap 635 through which the water can flow into linear pipe segment 610. The mechanism by which gap 635 is opened is described hereinabove with respect to FIGS. 3A and 3B. While water is draining through gap 635, the water flow inhibits air flow through the gap in the opposing direction (out of linear pipe segment 610) and as such during that time back flow of contaminated aerosol and/or bacteria is very limited and/or inhibited.

The increased pressure in linear pipe segment 610, caused by the use of the unidirectional valve 640, as described hereinabove with respect to FIGS. 2A and 2B, is relieved by a pressure equalizing conduit 650, which extends through pipe segment 510, a first portion 660 of drain trap 620 above the liquid level therein, and via a bore in wall 662 forming the U-shaped bend of drain trap 620 into a second portion 665 of drain trap 620, above the liquid level therein. As such, pressure equalizing conduit 650 is considered an internal pressure equalizing conduit. A first end 650*a* of pressure equalizing conduit 650 is disposed within linear pipe segment 610, adjacent unidirectional valve 640 and above the water level of drain trap 620. A second end 650*b* of pressure equalizing conduit 650 is disposed within drain trap 620, at portion 665 thereof adjacent wall 662, and above the liquid level within the drain trap. Second unidirectional valve 680 is disposed within pressure equalizing conduit 650, adjacent the second end 650*b* thereof, and is oriented to permit flow of gas from first end 650*a* to second end 650*b*, and to block gas flow in the opposite direction.

Pressure equalizing conduit 650 functions in the same manner as internal pressure equalizing conduit 250 described hereinabove with respect to FIGS. 2A and 2B, and serves to equalize the gas pressure between linear pipe segment 610 and portion 665 of drain trap 620, which is fluidly connected to the remainder of sewage pipe 630. As such, due to the pressure differential between linear pipe segment 610 and portion 665 of drain trap 620, and the direction of unidirectional valve 680, gas will flow through the pressure equalizing conduit from first end 650*a* to second end 650*b*, and from there to sewage pipe 630, thereby relieving the pressure and enabling proper functioning of unidirectional valve 640. Furthermore, the unidirectional valve 680, which prevents gas flow from second end 650*b* of the pressure equalizing conduit to first end 650*a*, ensures that the pressure equalizing conduit is not used as a "bypass" to the drain trap. As such, no sewage or otherwise contaminated gases can flow through pressure equalizing conduit 650 from sewage pipe 630 to linear pipe segment 610.

Figure 7A:
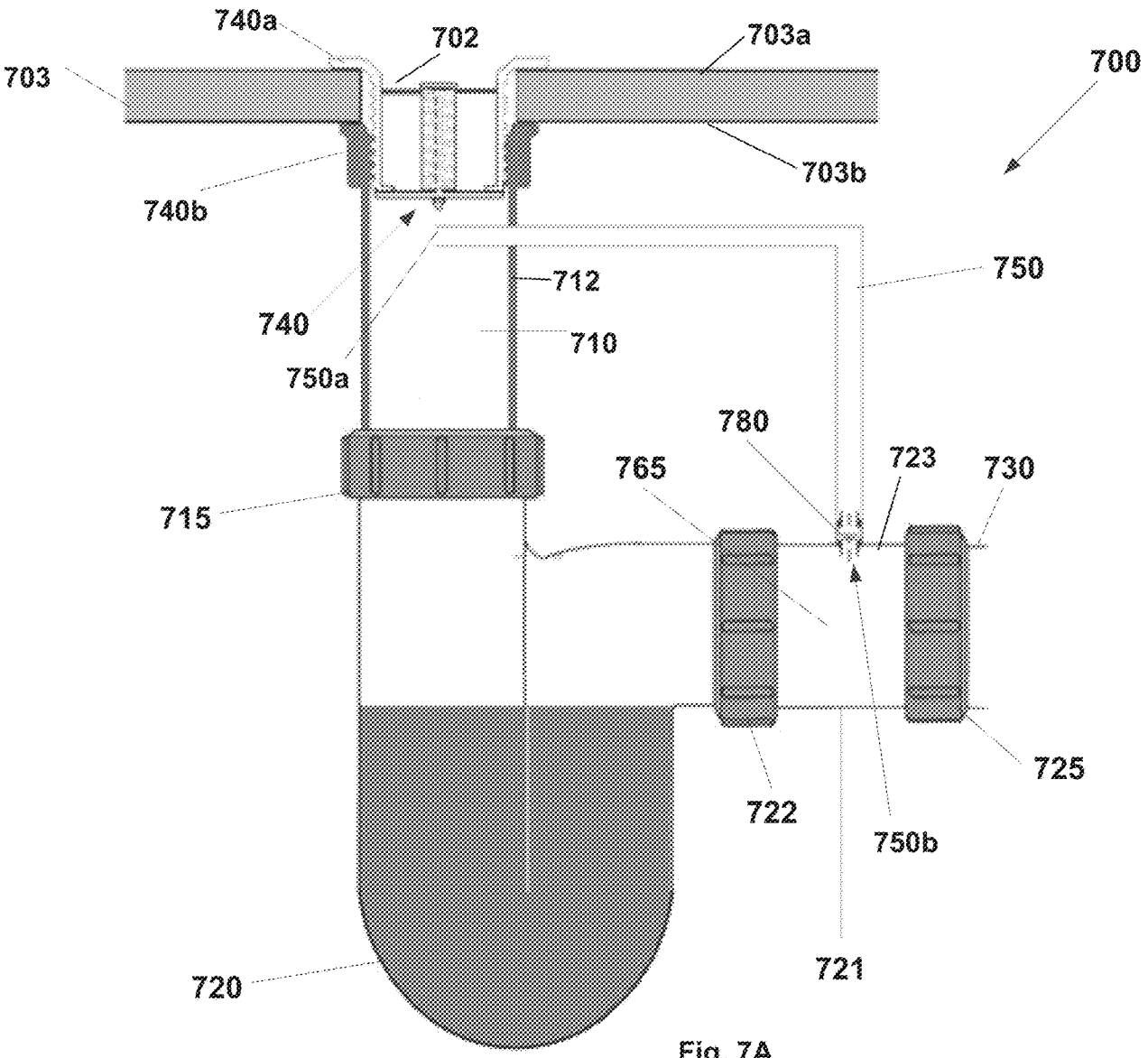
FIGS. 7A and 7B are schematic illustrations of a drain pipe connector including an external pressure equalizing conduit including a second unidirectional valve according to a further embodiment of the present invention, where
Figure 7B:
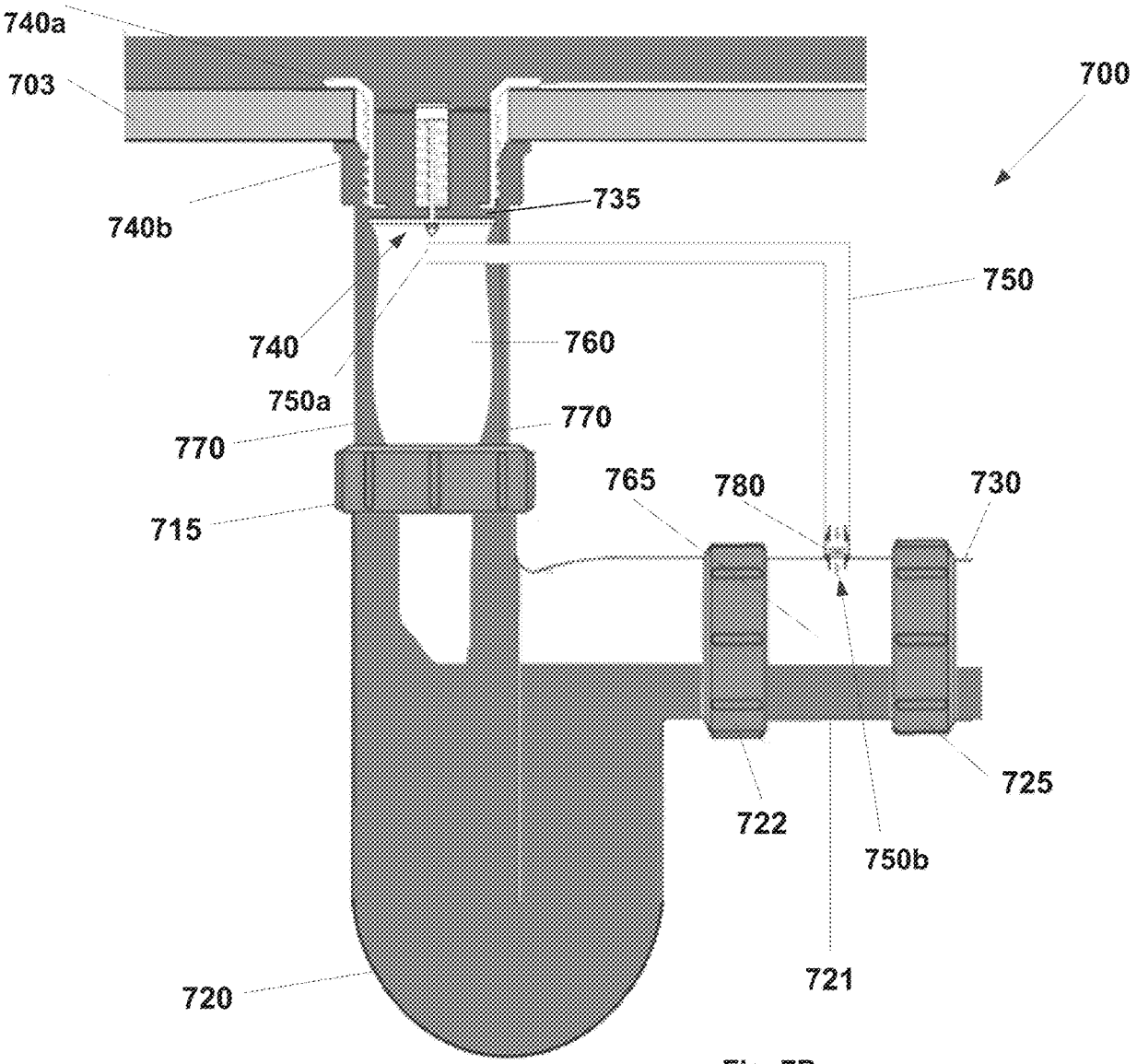

Reference is now made to FIGS. 7A and 7B, which are schematic illustrations of a drain pipe connector 700 including an external pressure equalizing conduit 750 including a second unidirectional valve 780 according to a further embodiment of the present invention. The drain pipe connector 700 illustrated in FIGS. 7A and 7B is substantially similar to the drain pipe connector 500 of FIGS. 5A and 5B, with the main differences therebetween being the presence of an additional pipe segment between the drain trap and the sewage pipe, and a second unidirectional valve 780 at the second end of the pressure equalizing conduit, as explained herein.

As seen in FIGS. 7A and 7B, drain pipe connector 700 includes a linear pipe segment 710, connected to a drain trap, or siphon, 720 via a first connector 715. Drain trap 720 is connected to a second linear pipe segment 721 via a second connector 722, and the second linear pipe segment 721 is connected to a sewage drain pipe 730 via a third connector 725. In some embodiment, first connector 715, second connector 722, and/or third connector 725 may be drain trap nuts as commonly used in the art of plumbing. However, any other suitable connection mechanism is considered to be within the scope of the present invention.

Linear pipe segment 710 is connected to a drain portal 702 of a plumbing fixture 703, such as a sink, via a unidirectional valve 740. Unidirectional valve 740 includes a first body portion 740*a*, mounted onto an upper surface 703*a* of fixture 703, and a second body portion 740*b*, fixedly and/or sealingly connected to first body portion 740*a* and engaging a lower surface 703*b* of fixture 703. In the embodiment illustrated in FIGS. 7A and 7B, the unidirectional valve 740 is equivalent to the unidirectional valve 240 shown in FIGS. 2A to 3B. However, the invention may instead utilize the unidirectional valve of FIGS. 4A to 4B, or any other suitable unidirectional valve which allows running water to flow, and seals the passage between the drain trap and the fixture when no water is flowing.

As discussed hereinabove with respect to FIGS. 3A and 3B and with respect to FIGS. 4A and 4B, the unidirectional valve is normally closed, such that when no water flows into/onto the valve, the valve is sealed to fluid flow into and/or out of drain trap 720 and linear pipe segment 710, thereby preventing back flow of bacterial and/or contaminated aerosol from pipe 710 into fixture 703. As such, the unidirectional valve 740 is normally closed.

When water flows into unidirectional valve 740, it applies pressure thereto which causes the valve to open. As such, as seen in FIG. 7B, when water 770 drains through portal 702 of fixture 703 and into unidirectional valve 740, the weight of the water causes the valve to open a gap 735 through which the water can flow into linear pipe segment 710. The mechanism by which gap 735 is opened is described hereinabove with respect to FIGS. 3A and 3B. While water is draining through gap 735, the water flow inhibits air flow through the gap in the opposing direction (out of linear pipe segment 710) and as such during that time back flow of contaminated aerosol and/or bacteria is very limited and/or inhibited.

The increased pressure in linear pipe segment 710, caused by the use of the unidirectional valve 740, as described hereinabove with respect to FIGS. 2A and 2B, is relieved by a pressure equalizing conduit 750, parts of which extend externally to pipe segment 710, drain trap 720, and second linear pipe segment 721. As such, pressure equalizing conduit 750 is considered an external pressure equalizing conduit. A first end 750*a* of pressure equalizing conduit 750 is disposed within linear pipe segment 710, adjacent unidirectional valve 740 and above the water level of drain trap 720. From there, the pressure equalizing conduit 750 extends through a portal in a wall 712 of linear pipe segment 710 to an exterior thereof, and through a portal in a wall 723 of second linear pipe segment 721, such that a second end 750*b* of pressure equalizing conduit 750 is disposed within second linear pipe segment 721, downstream of drain trap 720 and above the liquid level within the drain trap. Second unidirectional valve 780 is disposed within pressure equalizing conduit 750, adjacent the second end 750*b* thereof, and is oriented to permit flow of gas from first end 750*a* to second end 750*b*, and to block gas flow in the opposite direction.

Pressure equalizing conduit 750 functions in the same manner as internal pressure equalizing conduit 250 described hereinabove with respect to FIGS. 2A and 2B, and serves to equalize the gas pressure between linear pipe segment 710 and second linear pipe segment 721, which is fluidly connected to the remainder of sewage pipe 730. As such, due to the pressure differential between linear pipe segment 710 and second linear pipe segment 721, and the direction of unidirectional valve 780, gas will flow through the pressure equalizing conduit from first end 750*a* to second end 750*b*, and from there to sewage pipe 730, thereby relieving the pressure and enabling proper functioning of unidirectional valve 740. Furthermore, the unidirectional valve 780, which prevents gas flow from second end 750*b* of the pressure equalizing conduit to first end 750*a*, ensures that the pressure equalizing conduit is not used as a "bypass" to the drain trap. As such, no sewage or otherwise contaminated gases can flow through pressure equalizing conduit 750 from sewage pipe 730 to linear pipe segment 710.

In some embodiments, the pressure equalizing conduit may terminate in the environment of the fixture, rather than in the environment leading to the sewage. In such embodiments, the pressure equalizing conduit may have a filter, such as a biological filter, disposed therein, typically at the end thereof adjacent the environment of the fixture, in order to prevent biological contamination from being released to the environment.

In some embodiments of the invention, a filter, such as a biological filter, may be mounted in a bore between the first unidirectional valve and the liquid level within the drain trap, such as for example in a wall of the first linear pipe segment or in a side wall of the drain trap. This filter facilitates removal of air pressure from the region between the first unidirectional valve and the drain trap, into the environment surrounding the drain trap, such as a closet. In some such embodiments, the pressure equalizing conduit may be omitted, since the filter may provide sufficient gas-permeability to relieve the pressure buildup.

In some embodiments of the present invention, any one of the drain traps (220, 520, 620, and/or 720) may be directly connected to the second portion of the unidirectional valve (240*b*, 540*b*, 640*b*, and/or 740*b*, respectively), such that the first linear pipe segment (210, 510, 610, and/or 710) is obviated. The direct connection may be any suitable type of direct connection, such as a threaded or adhesive connection.

Figure 8:
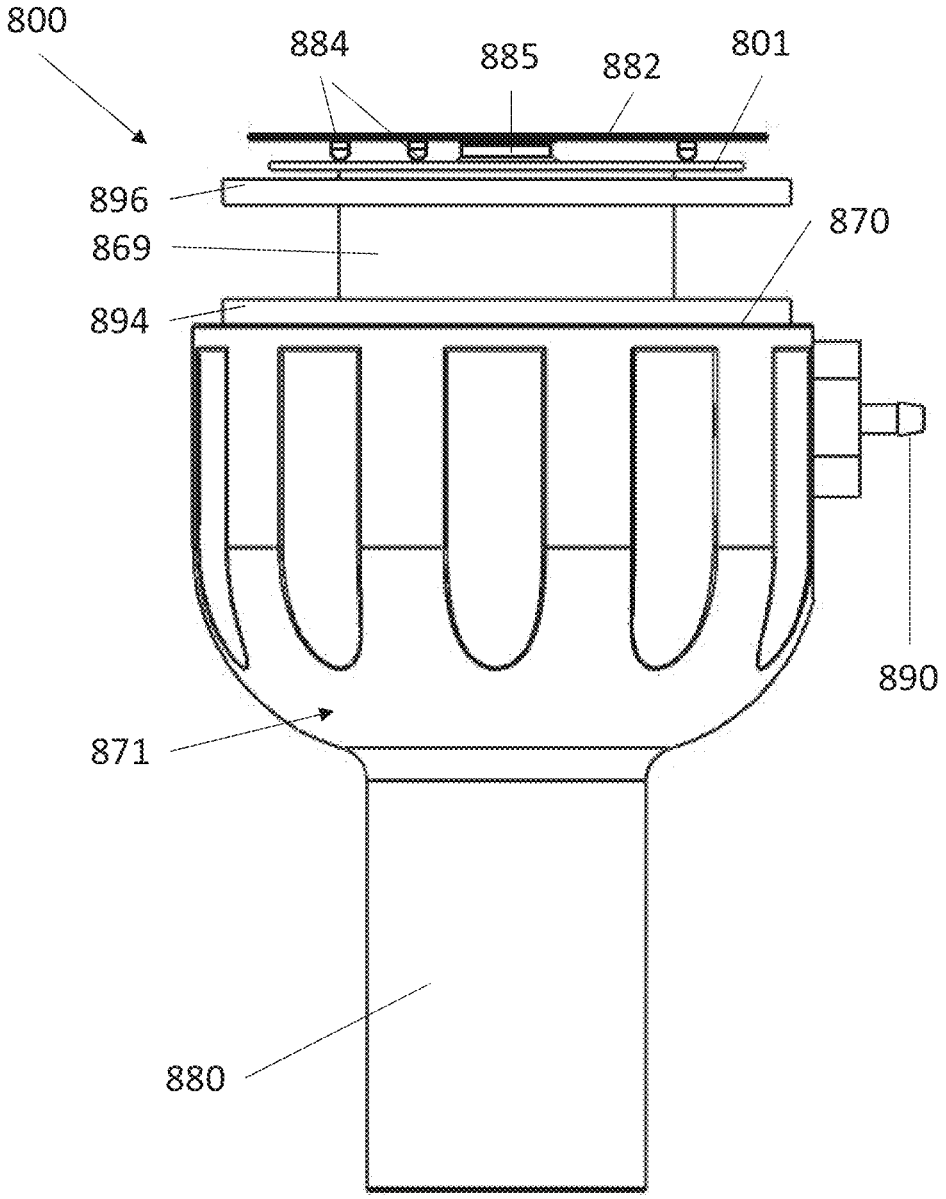
FIG. 8 is a plan view illustration of a kit for connection to a drainage system according to an embodiment of the present invention.
Figure 9:
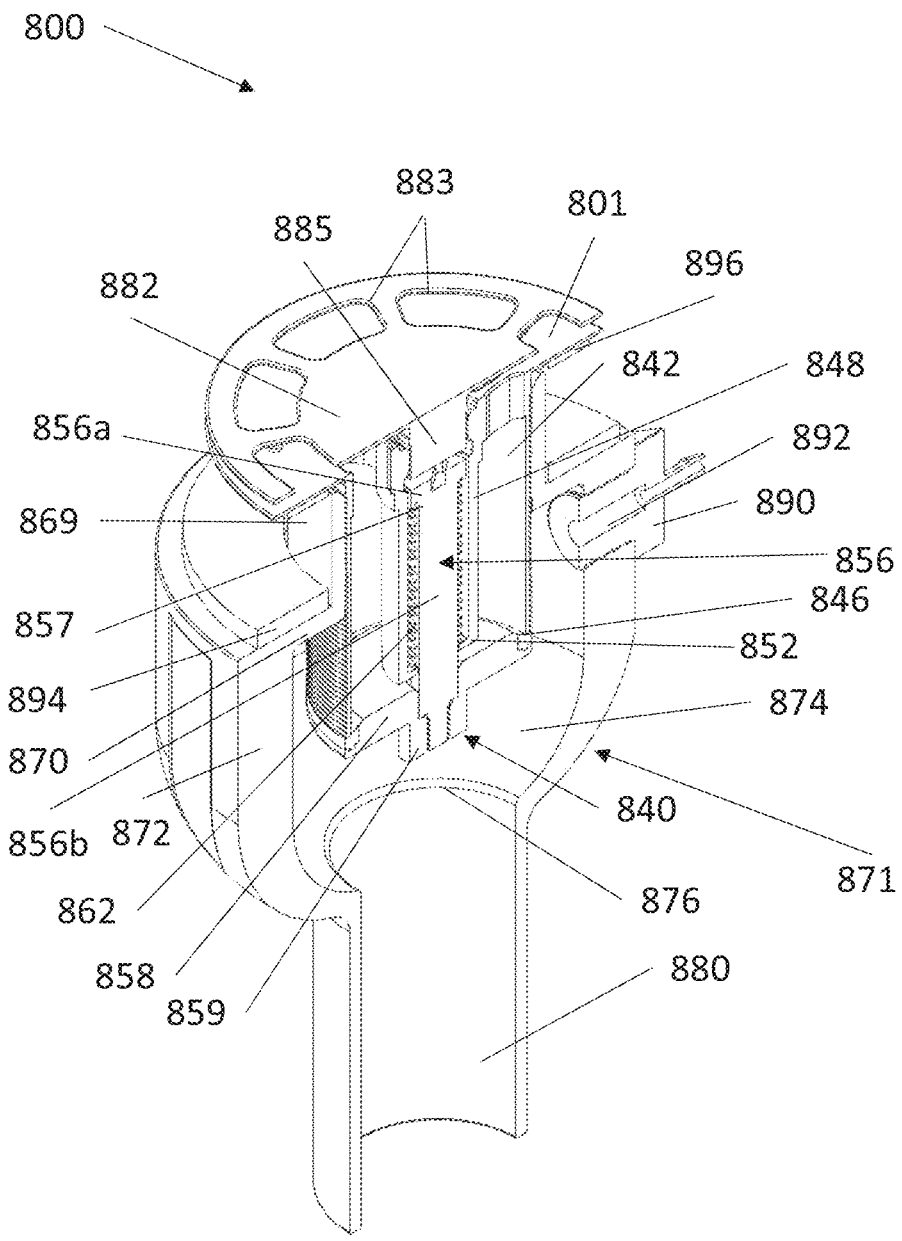
FIG. 9 is a perspective cross sectional illustration of the kit of FIG. 8.

Reference is now made to FIG. 8, which is a plan view illustration of a kit including a drain pipe connector 800 for connection to a drainage system according to an embodiment of the present invention, and to FIG. 9, which is a perspective cross sectional illustration of the kit of FIG. 8. The kit of FIGS. 8 and 9 may be installed at the time of installation of a drainage system, or may alternatively be used to retrofit an existing drainage system to have a unidirectional valve as disclosed herein.

As seen in FIGS. 8 and 9, drain pipe connector 800 includes a drain element 801 including one or more portals, the drain element adapted to be disposed in a drain portal of a plumbing fixture, such as a sink or tub, for draining of liquid from the plumbing fixture. Extending downstream from drain element 801 is a unidirectional valve 840, which is adapted to receive water that drains through drain element 801.

A cup element 871 includes a cylindrical portion 869, adapted to receive unidirectional valve. For example, in the illustrated embodiment, unidirectional valve 840 is adapted to be threaded into cylindrical portion 869 of cup element 871. A surface 870 extends radially outwardly from cylindrical portion 869, substantially parallel to drain element 801. A cylindrical wall 872 extends downwardly from surface 870, the cylindrical wall terminating in a convex, generally hemispherical portion 874 having a central bottom portal 876, extends downwardly from surface 870 around a lower portion of unidirectional valve 840. Portal 876 is connected to a linear pipe segment 880, which extends downwardly therefrom. Linear pipe segment 880 is connectable to, or insertable into, another pipe of a drainage system, such as a drain trap, or siphon.

Unidirectional valve 840 is similar to unidirectional valve 240 of FIGS. 3A and 3B. Unidirectional valve 840 includes a cylindrical body portion 842 terminating, at a bottom end thereof, in a sealing end 846.

A hollow cylindrical core 848 is disposed generally at the center of cylindrical body portion 842. Cylindrical core 848 is connected to a downwardly directed extension 801*a* of drain element 801, which extends into core 848. Core 848 terminates, at a bottom end thereof, in a radially inward lip 852.

A central rod 856 includes an upper portion 856*a* having a first diameter, and a lower portion 856*b* having a second, smaller diameter, such that a shoulder 857 is formed between the upper and lower portions of rod 856. Central rod 856 extends through core 848 and through a central bore in lip 852, such that a lower end of central rod 856 is attached to a sealing disc 858. Central rod 856 may be attached to sealing disc 858 by any suitable mechanism. However, in the illustrated embodiment, sealing disc 858 includes a downwardly extending cowl portion 859 which is snap fit around the lower end of central rod 856. Sealing disc 858 is sized and configured to engage, and seals against, sealing end 846 of cylindrical body portion 842. In some embodiments, sealing disc 858 and/or sealing end 846 may include an elastomer at an interface therebetween.

A compression spring 862 is disposed within core 848, about lower portion 856*b* of central rod 856. Compression spring 862 is seated between shoulder 857 of the central rod 856 and lip 852 of core 848. Compression spring 862 is configured such that when no pressure is applied thereto, for example when no water is draining through the unidirectional valve, sealing disc 858 engages and seals against sealing end 846. As such, the unidirectional valve 840 is normally closed.

When pressure is applied to sealing disc 858, such as when water is draining thereon from drain element 801, sealing disc 858 moves in a downward direction together with rod 856, such that upper portion 856*a* of rod 856 compresses compression spring 862 and a gap is created between sealing disc 858 and sealing end 846, substantially as described hereinabove. In this configuration, water flowing through drain element 801 causes opening of the unidirectional valve, and can flow through the gap formed in the unidirectional valve 840 into cup element 871 and from there, via portal 876, into linear pipe segment 880.

While water is draining through the gap in unidirectional valve 840, the water flow inhibits air flow through the gap in the opposing direction (out of linear pipe segment 880), thus preventing flow of contaminated air out of the sewage system.

When water stops draining onto sealing disc 858, compression spring 862 is decompressed and pushes shoulder 857 away from lip 852 of core 848. This motion of shoulder 857 is accompanied by upward motion of rod 856 and of sealing disc 858, thus resulting in closing of the gap and resealing of the unidirectional valve.

In some embodiments, drain pipe connector 800 may further include a filtering cover 882 including a plurality of bores 883, and having a plurality of spacers 884 on a lower surface thereof. Filtering cover 882 is adapted to be placed above drain element 801, such that bores 883 are not aligned with bores of the drain element, so as to prevent entrance of undesired items (such as sticks, needles, and the like) into the drain system. Spacers 884 ensure that there is a gap between filtering cover 882 and drain element 801, such that water can flow therebetween. A core portion 885 connected to a lower surface of filtering cover 882, substantially at the center thereof, is adapted to be disposed within core 848 above rod 856, to ensure proper placement of filtering cover 882.

However, it is appreciated that in some embodiments, filtering cover 882 may be replaced by a plugging cover, adapted to have a portion disposed within core 848 and to block passage of water into drain element 801.

As mentioned hereinabove with respect to unidirectional valve 240, one disadvantage of use of the unidirectional valve 840, particularly when it is used with linear pipe segment 880 connected to a drain trap, is that gas pressure may elevated in cup element 871 and in linear pipe segment 880. The increased gas pressure applies pressure onto the bottom surface of sealing disc 858, making it harder for unidirectional valve 840 to open and limiting water flow through the unidirectional valve.

As seen in FIGS. 8 and 9, a connector nipple 890 is disposed within cylindrical wall 872 of cup element 871, for example in a bore formed in the cylindrical wall. A bore 892 of connector nipple 890 is in fluid communication with an interior hollow of cup element 871, thereby enabling pressure equalizing between the interior of the cup element and the exterior thereof. Connector nipple 890 is connectable to a secondary element, adapted to enable equalizing of pressure between the interior hollow of cup element 871 and a second volume, having atmospheric pressure.

In some embodiments, a biological filter, a chemical filter, or any other filter for contaminants which may flow into drain element 801 or out of a drain trap connected to linear pipe segment 880, may be attached to connector nipple 890, such that air flowing out of cup element 871 via connector nipple 890 is filtered. In such embodiments, there is no fear that contaminants will be released into the environment surrounding an exterior of cup element 871, and there is no necessity to further process or handle air released from connector nipple 890 and the filter thereof.

In other embodiments, a pressure equalizing conduit may be connectable to connector nipple 890, as explained herein.

In some embodiments, a first annular elastomer 894 may be disposed on an upper surface of surface 870, and/or a second annular elastomer 896 may be disposed on a lower surface of drain element 801, so as to securely separate the drain pipe connector 800 from the surface of a plumbing fixture in which it is installed.

Figure 10:
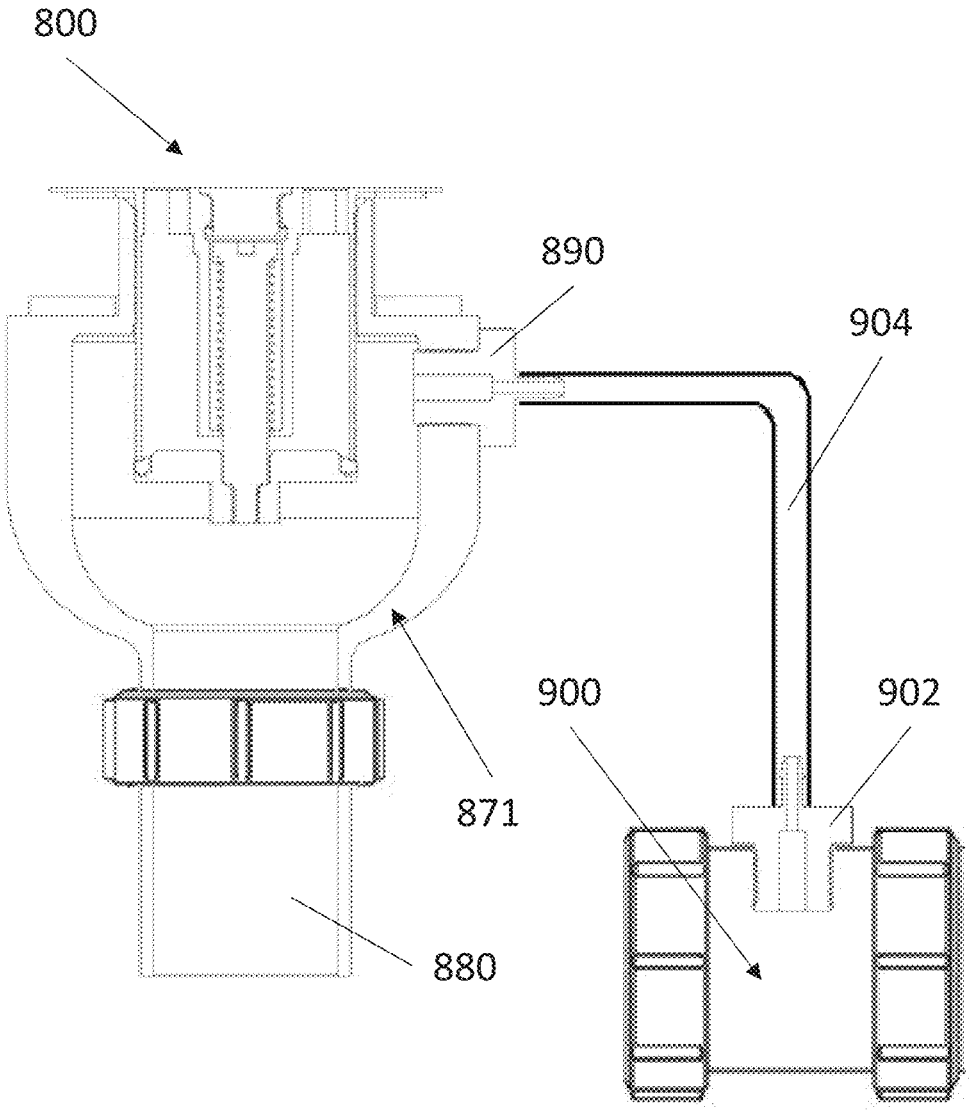
FIG. 10 is a planar cross sectional illustration of a second kit for connection to a drainage system, using the kit of FIG. 8.

Reference is now made to FIG. 10, which is a planar cross sectional illustration of a second kit for connection to a drainage system, using the kit of FIG. 8. As seen in FIG. 10, the kit thereof includes drain pipe connector 800 of FIGS. 8 and 9, as well as a second linear pipe segment 900. Linear pipe segment 900 is adapted to be connectable between a drain trap and a sewage pipe, downstream of the drain trap. Linear pipe segment 900 includes a second connector nipple 902 which may, for example, be disposed in a bore formed in the cylindrical wall of pipe segment 900.

Second connector nipple 902 is connectable to connector nipple 890 by a suitable conduit 904, which functions as a pressure equalizing conduit. As such, super-atmospheric pressure within cup element 871 is released by flow of gas from connector nipple 890, via conduit 904 to connector nipple 902, and from there into second linear pipe segment 900 and to the sewage system. In some embodiments, conduit 904 may include a second unidirectional valve, allowing flow from first connector nipple 890 to second connector nipple 902, and preventing flow in the opposing direction.

Figure 11:
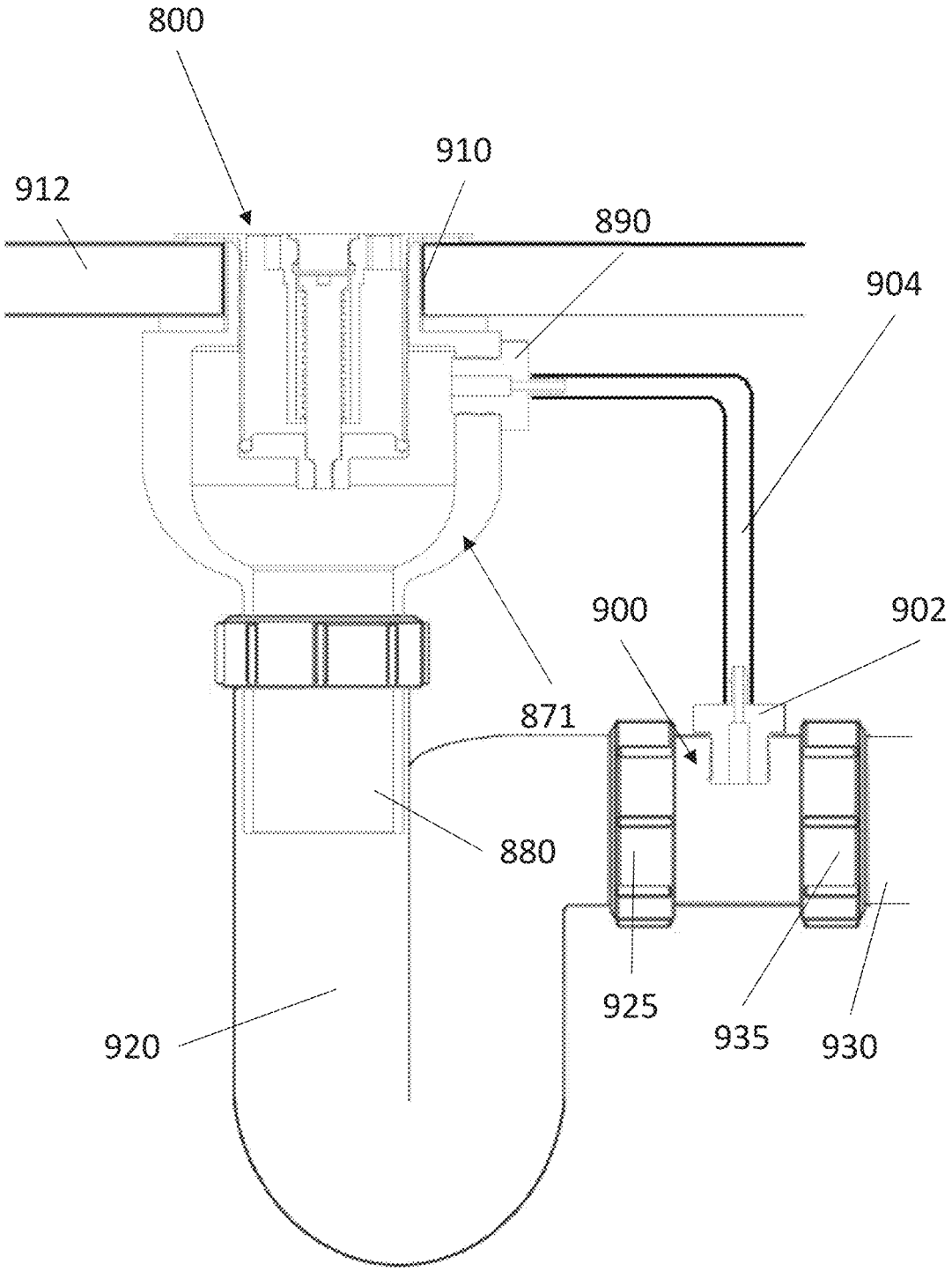
FIG. 11 is a planar cross sectional illustration of the second kit of FIG. 10, when installed in a drainage system.

Reference is now additionally made to FIG. 11, which is a planar cross sectional illustration of the second kit of FIG. 10, when installed in a drainage system. As seen in FIG. 11, drain pipe connector 800 is installed in a portal 910 of a plumbing fixture 912, such as a sink or bathtub, such that linear pipe segment 880 thereof is inserted into a drain trap 920. Second pipe segment 900 is disposed downstream of drain trap 920, and connects between the drain trap 920 and a sewage pipe 930. As described above, drain trap 920 and second pipe segment 900, as well as second pipe segment 900 and sewage pipe 930, may be connected to one another using any mechanism known in the art, such as respective connectors 925 and 935, illustrated in FIG. 11. Pressure equalizing conduit 904 is disposed between connector nipples 890 and 902, enabling gas flow between the interior hollow of cup element 871 and the interior hollow of second linear pipe segment 900.

Similarly to that described hereinabove, in the arrangement of FIG. 11, water or other liquids draining from plumbing fixture 912 flows through drain element 801 and cause opening of the unidirectional valve 840. The liquid then flows into cup element 871 and from there, via linear pipe segment 880, into drain trap 920 and into the sewage. Because of the increased pressure in cup element 871, air and gasses flow through connector nipple 890, pressure equalizing conduit 904, and second connector nipple 902 into second linear pipe segment, is in fluid communication with the sewage system and therefore has atmospheric pressure, thereby equalizing the pressure between cup element 871 and second linear pipe segment 900. Furthermore, because second linear pipe segment 900, into which the gas flows, is downstream of drain trap 920, there is no risk of contaminants in the air will be able to be released back into the environment, substantially as described hereinabove.

It will be appreciated by people of skill in the art that the second connector nipple 902 need not necessarily be disposed in a dedicated pipe segment, such as second linear pipe segment 900. In some embodiments, the second connector nipple 902 may be disposed in a bore in drain trap 920, downstream of the U-shaped bend thereof, in a similar manner to that shown in FIGS. 5A and 5B. Alternately, the second connector nipple 902 may be disposed in a wall of sewage pipe 930, and the system would function in the same manner illustrated.

Figure 12:
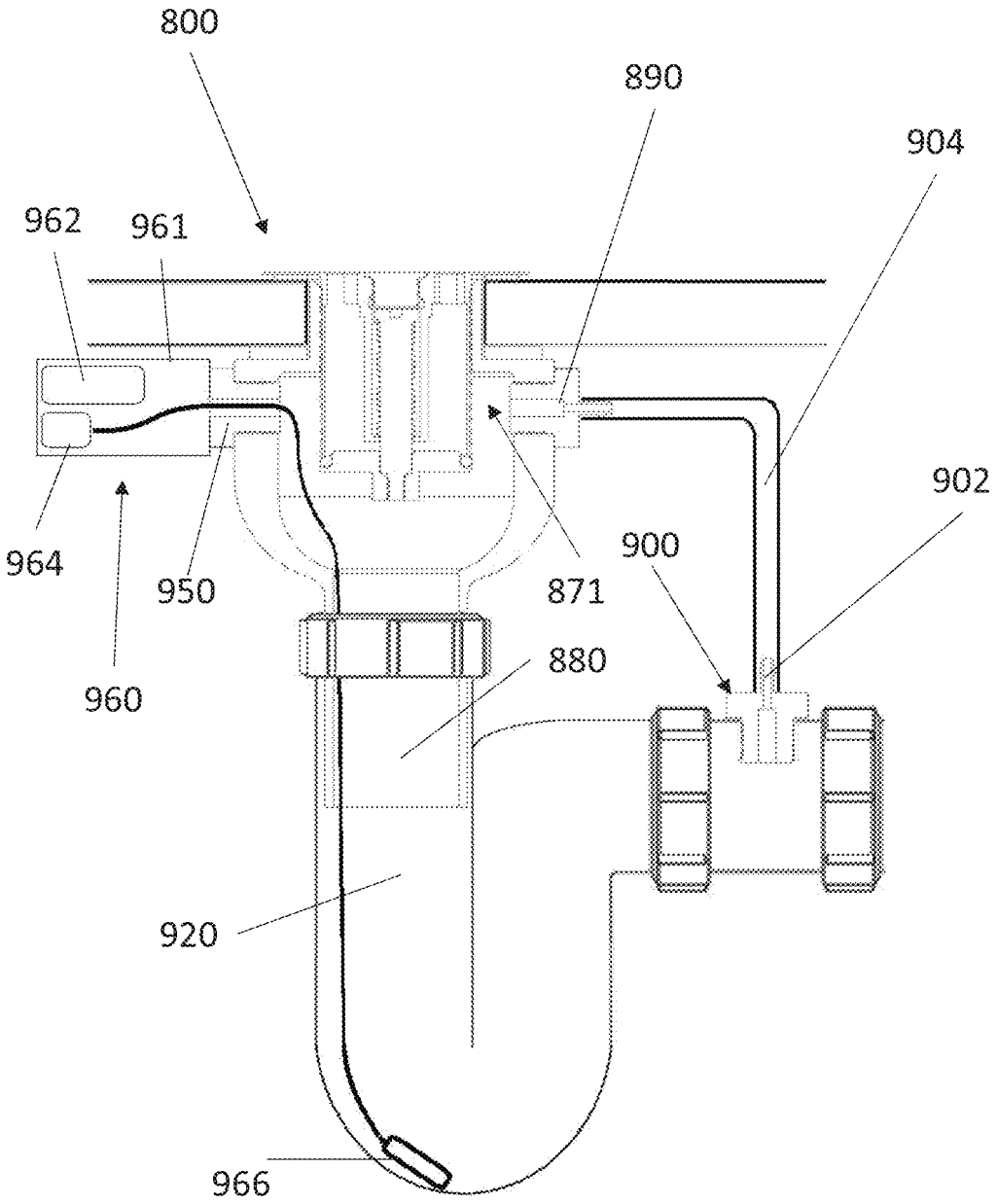
FIG. 12 is a planar cross sectional illustration of a third kit installed in a drainage system, using the kit of FIG. 10.
Figure 13:
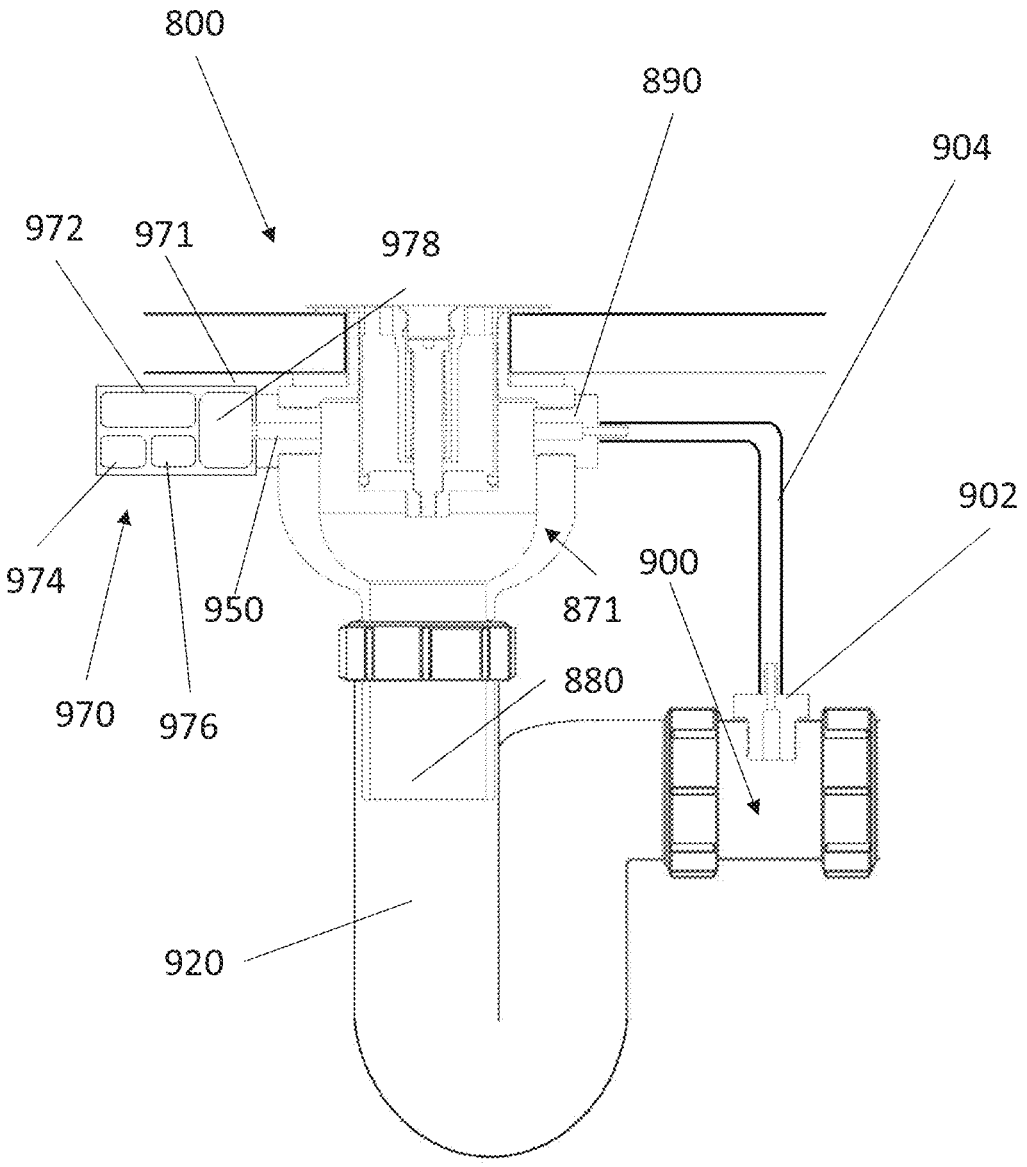
FIG. 13 is a planar cross sectional illustration of a fourth kit installed in a drainage system, using the kit of FIG. 10.

Reference is now made to FIGS. 12 and 13, which are planar cross sectional illustration of additional kits, using the kit of FIG. 10, when installed in a drainage system.

As seen in FIGS. 12 and 13, the kits thereof include, in addition to the kit thereof includes drain pipe connector 800 of FIGS. 8 and 9, as well as second linear pipe segment 900 and second connector nipple 902 of FIGS. 10 and 11. The kits of FIGS. 12 and 13 further include a third connector nipple 950, which be disposed in a bore formed in a wall of drain pipe connector 800.

In the embodiment illustrated in FIG. 12, the third connector nipple 950 is connectable to a biofilm treatment device 960, for treatment of biofilm already formed in drain trap 920.

Biofilm treatment device 960 includes a housing 961 attached to third connector nipple 950 and housing a power supply 962, such as one or more batteries, and a processor 964 functionally associated with the power supply. At least one biofilm treatment unit 966 (illustrated in FIG. 12 as a single such unit) is powered by power supply 962 and controlled by processor 964. Biofilm treatment unit 966 is disposed within drain trap 920, and is connected to housing 961 by a connection cable 968, extending through linear pipe segment 880, through cup element 871, and through third connector nipple 950.

Biofilm treatment unit 966 may be a unit using any suitable mechanism to treat biofilm, and/or to inhibit or prevent the formation of biofilm.

In some embodiments, at least one biofilm treatment unit 966 is a vibrator adapted to vibrate the liquid within drain trap 920 so as to inhibit formation of biofilm and/or to break down existing biofilm.

In some embodiments, at least one biofilm treatment unit 966 is a liquid circulating pump, adapted to circulate the liquid within drain trap 920 so as to inhibit formation of biofilm.

In some embodiments, at least one biofilm treatment unit 966 is a heating unit adapted to heat the liquid within drain trap 920 so as to exterminate bacteria, viruses, and/or other biological contaminants in the drain trap liquid, and thus to inhibit formation of biofilm.

In some embodiments, at least one biofilm treatment unit 966 is an ultra-violet light source adapted to illuminate the liquid within drain trap 920 using ultra-violet light so as to exterminate bacteria, viruses, and/or other biological contaminants in the drain trap liquid, and thus to inhibit formation of biofilm. In some such embodiments, drain trap 920 may be transparent.

It is a particular feature of the present invention that one or more biofilm treatment units 966 may be introduced into drain trap 920, or removed therefrom, at the user's convenience and in accordance with the user's needs. As such, different biofilm treatment units may be used simultaneously or interchangeably.

For example, consider a hospital room, in which the kit of FIG. 12 is installed. During normal function of the hospital room, use of a vibrator in the drain pump inhibits the formation of biofilm sufficiently that, even if some biofilm is formed, no aerosol is released due to the unidirectional valve 840. However, at specific times, for example when an immuno-compromised patient is in that room, or when the room has to function as a medical isolation room, use of a vibrator to stir the liquid in the drain trap does not result in a sterile enough environment. In such cases, a second biofilm treatment unit, such as a UV light source, may be introduced into the drain trap, in addition to or in place of the vibrator, so as to improve the conditions within the room.

In the embodiment illustrated in FIG. 13, the third connector nipple 950 is connectable to a liquid treatment device 970, for treatment of liquid draining through the drain pipe connector 800 so as to prevent formation of biofilm thereby.

Liquid treatment device 970 includes a housing 971 attached to third connector nipple 950 and housing a power supply 972, such as one or more batteries, a processor 974 functionally associated with the power supply, a motor or engine 976 controlled by the processor, and a treatment liquid pump 978 controlled by engine 976 and associated with a treatment liquid reservoir (not explicitly shown).

In use, treatment liquid pump 978 periodically or intermittently pumps a quotient of treatment liquid, via third connector nipple 950 into drain pipe connector 800, which quotient of treatment liquid reaches drain trap 920 to treat liquid therein.

In some embodiments, the quotient of liquid may be a fixed quotient, pumped at each operation of treatment liquid pump 978. In other embodiments, different quotients of treatment liquid may be pumped at different times.

In some embodiments, the pumping of treatment liquid may occur at fixed intervals, such as once an hour, once every 30 minutes, or once every 15 minutes.

In some embodiments, any one or more of the kits of FIGS. 8, 9, 10, 12, and 13, may be used to retrofit an existing drain system to include a unidirectional valve in accordance with the present invention. In such cases, an existing drain arrangement leading to an existing drain trap would be disconnected from the drain trap and removed from the plumbing fixture, and drain pipe connector 800 of FIGS. 8 and 9 would be connected to the existing drain trap. In some embodiments, the second linear pipe segment may then be connected between the existing drain trap and an existing sewage pipe, in which case pressure equalizing conduit 904 would be employed to connect connector nipples 890 and 902.

Figure 15A:
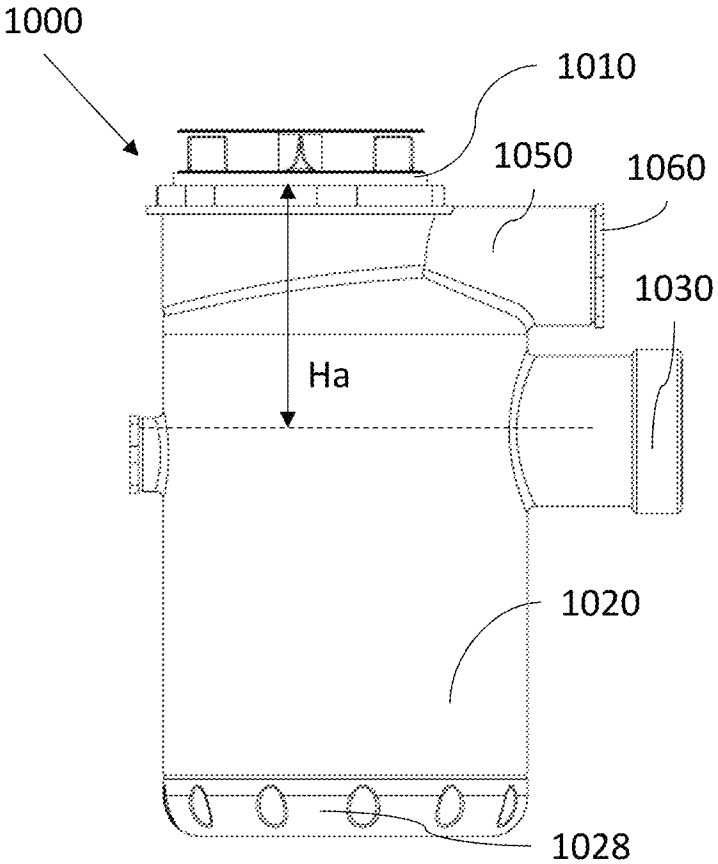
FIGS. 15A, 15B, and 15C are planar side view illustrations of the drain pipe connector system of FIG. 14, in three operative states.
Figure 14:
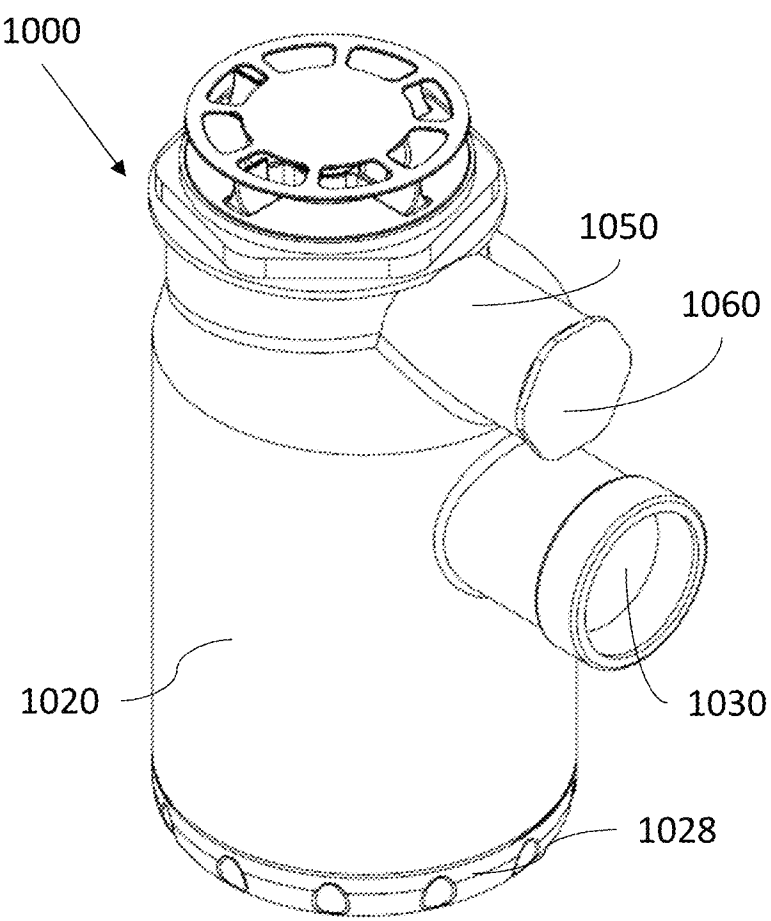
FIG. 14 is a perspective view illustration of a drain pipe connector system including a pressure equalizing mechanism, according to another embodiment of the present invention.
Figure 15C:
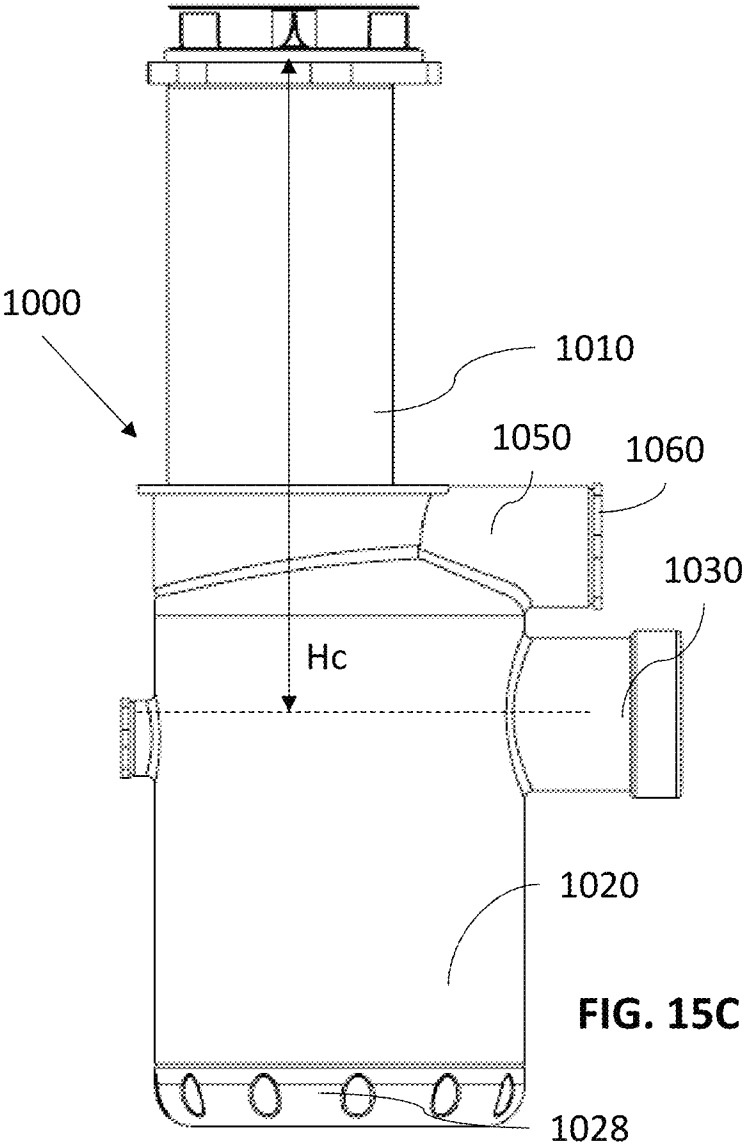
Figure 15B:
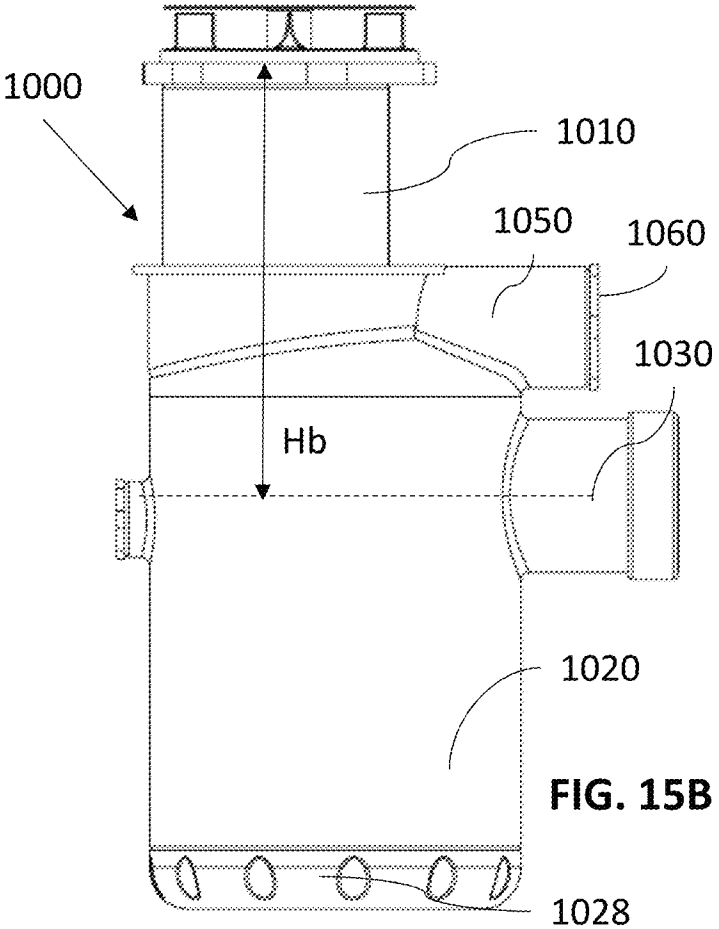
Figure 16B:
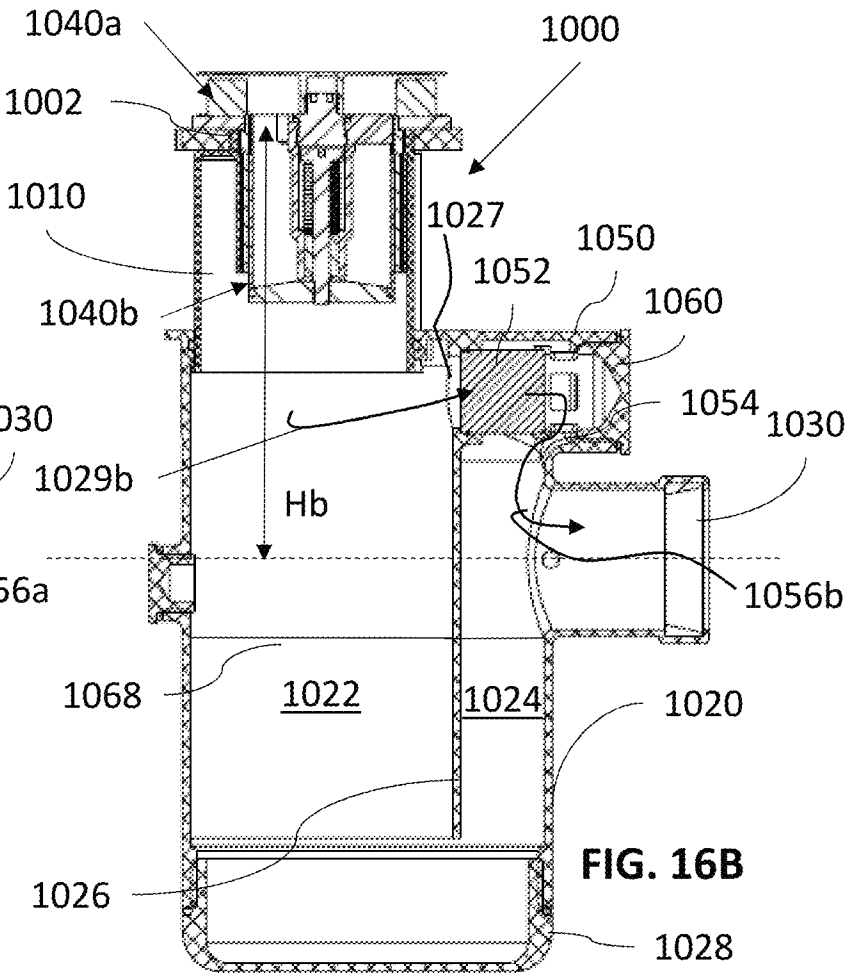
FIGS. 16A, 16B, and 16C are sectional illustrations of the drain pipe connector system of FIGS. 14 to 15C, in the three operative states shown in FIGS. 15A, 15B, and 15C, respectively.
Figure 16A:
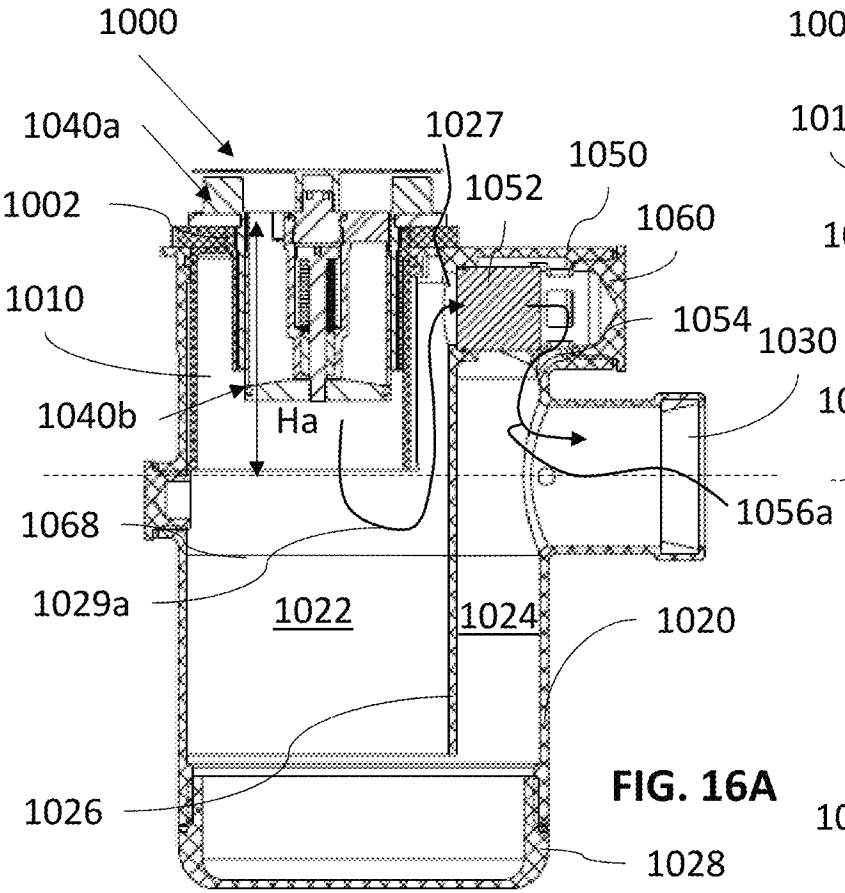
Figure 16C:
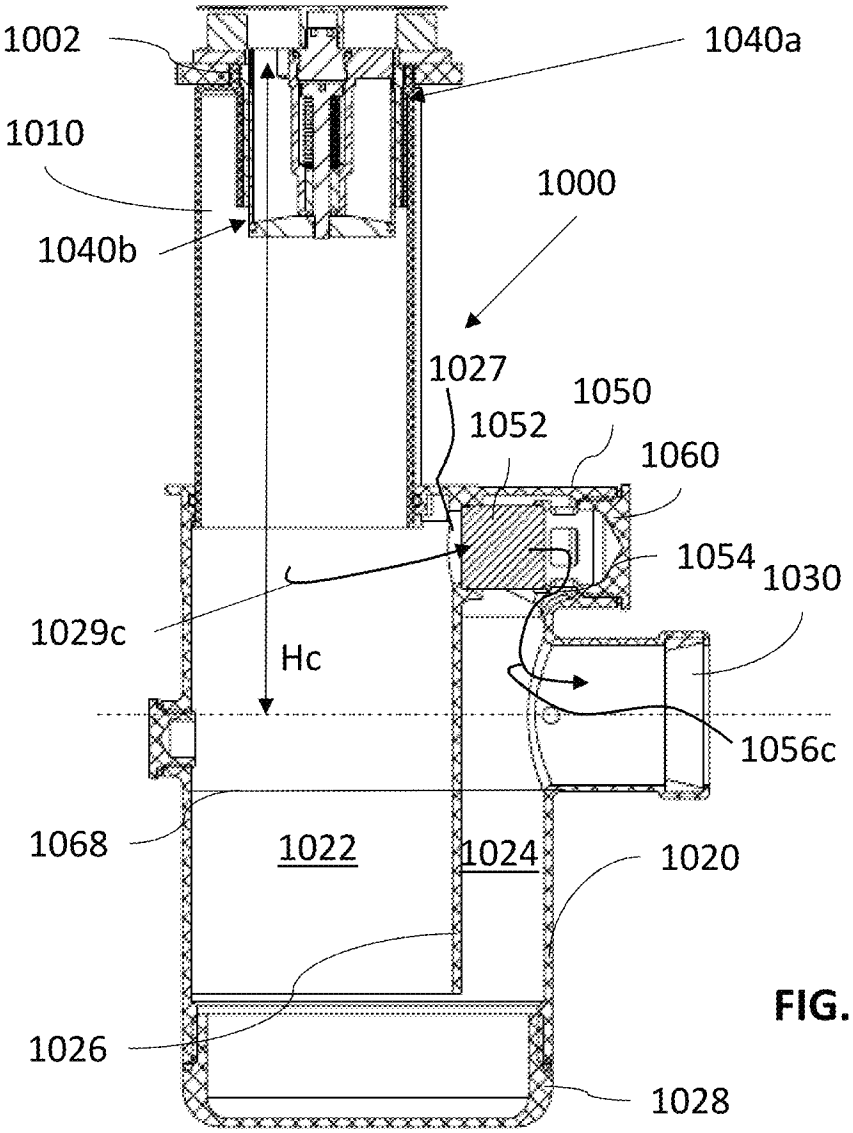

Reference is now made to FIG. 14, which is a perspective view illustration of a drain pipe connector system 1000 including a pressure equalizing mechanism, according to another embodiment of the present invention, to FIGS. 15A, 15B, and 15C, which are planar side view illustrations of the drain pipe connector system 1000, in three operative states, and to FIGS. 16A, 16B, and 16C, which are sectional illustrations of the drain pipe connector system 1000 in the three operative states of FIGS. 15A, 15B, and 15C, respectively.

As seen, drain pipe connector system 1000 includes a linear pipe segment 1010, slidably disposed within a drain trap, or siphon, 1020. In some embodiments, drain trap 1020 is integrally formed with a sewage drain pipe 1030.

In the embodiment illustrated in FIGS. 14 to 16, drain trap 1020 is a unitarily formed element, including a downward flow path 1022 and an upward flow path 1024, separated by a wall 1026. Downward flow path 1022 is in fluid communication with upward flow path 1024 via a removable drain trap cap 1028, sealingly arranged about a lower end of drain trap 1020. Sewage drain pipe 1030 is in fluid communication with upward flow path 1024.

As seen clearly in FIG. 16, linear pipe segment 1010 is disposed within downward flow path 1022. However, a diameter of linear pipe segment 1010 (indicated by D1) is smaller than a diameter of downward flow path 1022 (indicated by D2), such that fluid can flow from linear pipe segment 1010 to the entire length of downward flow path 1022.

Linear pipe segment 1010 is adapted to be connected to a drain portal 1002 of a plumbing fixture, such as a sink, via a unidirectional valve 1040.

Because drain trap 1020 is integrally formed with sewage drain pipe 1030, in some embodiments, the height at which drain trap 1020 is installed, relative to portal 1002, may be determined by a height of the center of sewage drain pipe 1030. As such, the installation conditions may require a longer linear pipe segment 1010 to bridge the gap between the heights of the portal and of the sewage pipe. To facilitate different size gaps, linear pipe segment 1010 is slidable relative to downward flow path 1022 of drain trap 1020, as seen by comparison of FIGS. 16A and 16B. Additionally, in some embodiments, linear pipe segments 1010 may have different longitudinal lengths, as seen by comparison of FIG. 16A (short linear pipe segment) and 16C (longer linear pipe segment). The difference in heights is also demonstrated by comparison of FIGS. 15A, 15B, and 15C, showing three different distances between the drain portal and the center of sewage drain pipe 1030, indicated by Ha, Hb, and Hc, in FIGS. 15A, 15B, and 15C, respectively. Similarly, comparison of FIGS. 16A, 16B, and 16C, demonstrates the same distances Ha, Hb, and Hc. The length of linear pipe 1010, and the extent to which it is disposed within trap 1020, are determined once at the time of installation. It is required that the end of linear pipe 1010, distal to portal 1002, be disposed above the water level 1068 within the drain trap, and approximately at the vertical center of sewage drain pipe 1030, to ensure that the linear pipe segment is in fluid communication with the pressure equalizing mechanism described hereinbelow.

Unidirectional valve 1040 includes a first body portion 1040*a*, adapted to be mounted onto an upper surface of the plumbing fixture, and a second body portion 1040*b*, fixedly and/or sealingly connected to first body portion 1040*a*. In the embodiment illustrated in FIGS. 14 to 16, the unidirectional valve 1040 is equivalent to the unidirectional valve 240 shown in FIGS. 2A to 3B. However, the invention may instead utilize the unidirectional valve of FIGS. 4A to 4B, or any other suitable unidirectional valve which allows running water to flow, and seals the passage between the drain trap and the fixture when no water is flowing.

As discussed hereinabove with respect to FIGS. 3A and 3B and with respect to FIGS. 4A and 4B, the unidirectional valve is normally closed, such that when no water flows into/onto the valve, the valve is sealed to fluid flow into and/or out of drain trap 1020 and linear pipe segment 1010, thereby preventing back flow of bacterial and/or contaminated aerosol from pipe 1010 into the plumbing fixture. As such, the unidirectional valve 1040 is normally closed.

When water flows into unidirectional valve 1040, it applies pressure thereto which causes the valve to open. As such, when water drains through the portal of the plumbing fixture and into unidirectional valve 1040, the weight of the water causes the valve to open a gap through which the water can flow into linear pipe segment 1010. The mechanism by which the gap is opened is described hereinabove with respect to FIGS. 3A and 3B. While water is draining through the gap, the water flow inhibits air flow through the gap in the opposing direction (out of linear pipe segment 1010) and as such during that time back flow of contaminated aerosol and/or bacteria is very limited and/or inhibited.

The increased pressure in linear pipe segment 1010, caused by the use of the unidirectional valve 1040, as described hereinabove with respect to FIGS. 2A and 2B, is relieved by a pressure equalizing element 1050. Pressure equalizing element 1050 comprises a tube, or conduit, which in some embodiments may be integrally formed with drain trap 1020, and is in fluid communication with downward flow path 1022 via a first end thereof which extends from a bore 1027 in an upper portion of wall 1026, above a water level in drain trap 1020. Because of the fluid flow communication between the linear pipe segment 1010 and downward flow path 1022, pressure equalizing element 1050 is also in fluid communication with linear pipe segment 1010, as indicated by arrows 1029*a*, 1029*b*, and 1029*c* in FIGS. 16A, 16B, and 16C, respectively. In some embodiments, a second unidirectional valve 1052 is disposed within pressure equalizing element 1050, adjacent bore 1027, to prevent fluid flow from pressure equalizing element 1050 to downward flow path 1022. Second unidirectional valve 1052 ensures that there will be no back flow of gas from the sewage to downward flow path 1022, for example if pressure in the upward flow path 1024 increases (e.g. because of a blockage in the sewage).

In some embodiments, pressure equalizing element 1050 is in fluid communication with upward flow path 1024, downstream of second unidirectional valve 1052, via a pathway 1054 in the conduit of pressure equalizing element 1050, as indicated by arrows 1056*a*, 1056*b*, and 1056*c* in FIGS. 16A, 16B, and 16C, respectively. As such pressure equalizing element 1050 is in fluid communication with sewage drain pipe 1030. In the embodiment illustrated in FIGS. 14 to 16, a second end of pressure equalizing element 1050 is sealed by a cap 1060, such that fluid flowing from the first end of pressure equalizing element toward the second end, can exit the pressure equalizing element via pathway 1054.

In use, when gas pressure accumulates in downward flow path 1022 above a water level 1068 of drain trap 1020, the pressurized gas flows into pressure equalizing element 1050 via second unidirectional valve 1052 as indicated by arrows 1029*a*, 1029*b*, and/or 1029*c* and flows toward the second end of the pressure equalizing element. Because the second end of the pressure equalizing element is sealed by cap 1060, the pressurized gas flows through pathway 1054 to upward flow path 1024, and from there can flow to sewage drain pipe 1030, as indicated by arrows 1056*a*, 1056*b*, and/or 1056*c*. As such, pressure equalizing element 1050 functions in a similar manner to internal pressure equalizing tube 250 described hereinabove with respect to FIGS. 2A and 2B, and serves to equalize the gas pressure between linear pipe segment 1010 and downward flow path 1024 of drain trap 1020, which is fluidly connected to sewage pipe 1030.

Due to the pressure differential between linear pipe segment 1010 and downward flow path 1022 (above the water level 1068 of trap 1020) and upward flow path 1024 of drain trap 1020, gas will flow from bore 1027, through the unidirectional valve 1052 into the pressure equalizing element 1050 toward the second end thereof, and from there via pathway 1054 to upward flow path 1024 and to sewage pipe 1030, thereby relieving the pressure and enabling proper functioning of unidirectional valve 1040. Furthermore, because the bacteria and/or contaminated aerosols that the invention is designed to block are disposed within linear pipe segment 1010, the airborne bacteria and/or contaminated aerosol may also flow through pressure equalizing element 1050 away from portal 1002, and be trapped downstream of drain trap 1020, thereby further reducing or eliminating the chance of contaminated backflow through portal 1002. Unidirectional valve 1052, and the higher pressure in downward flow path 1022, prevent backflow of gas from sewage pipe 1030 to downward flow path 1022 or linear pipe segment 1010.

It is a particular feature of the disclosed technology that in a case of a flood, or of up-flow from the sewage, the up-flow would be blocked by unidirectional valve 1040, and would be able to exit the system 1000 and to return to the sewage by flowing through pressure equalizing element 1050.

Figure 17A:
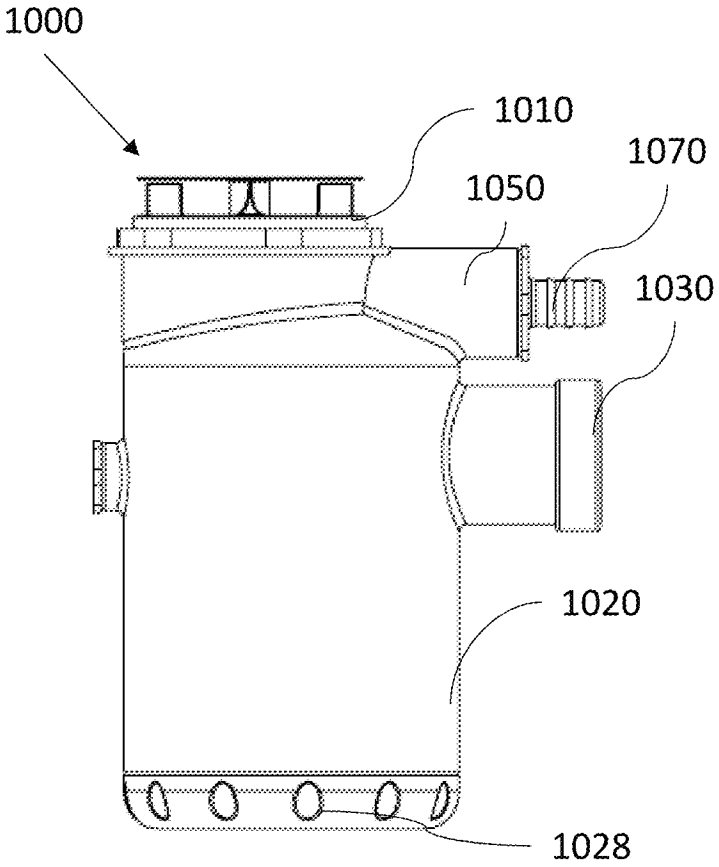
FIGS. 17A and 17B are, respectively, a planar side view illustration and a perspective sectional view of the drain pipe connector system of FIGS. 14 to 16C, including a connector nipple.
Figure 17B:
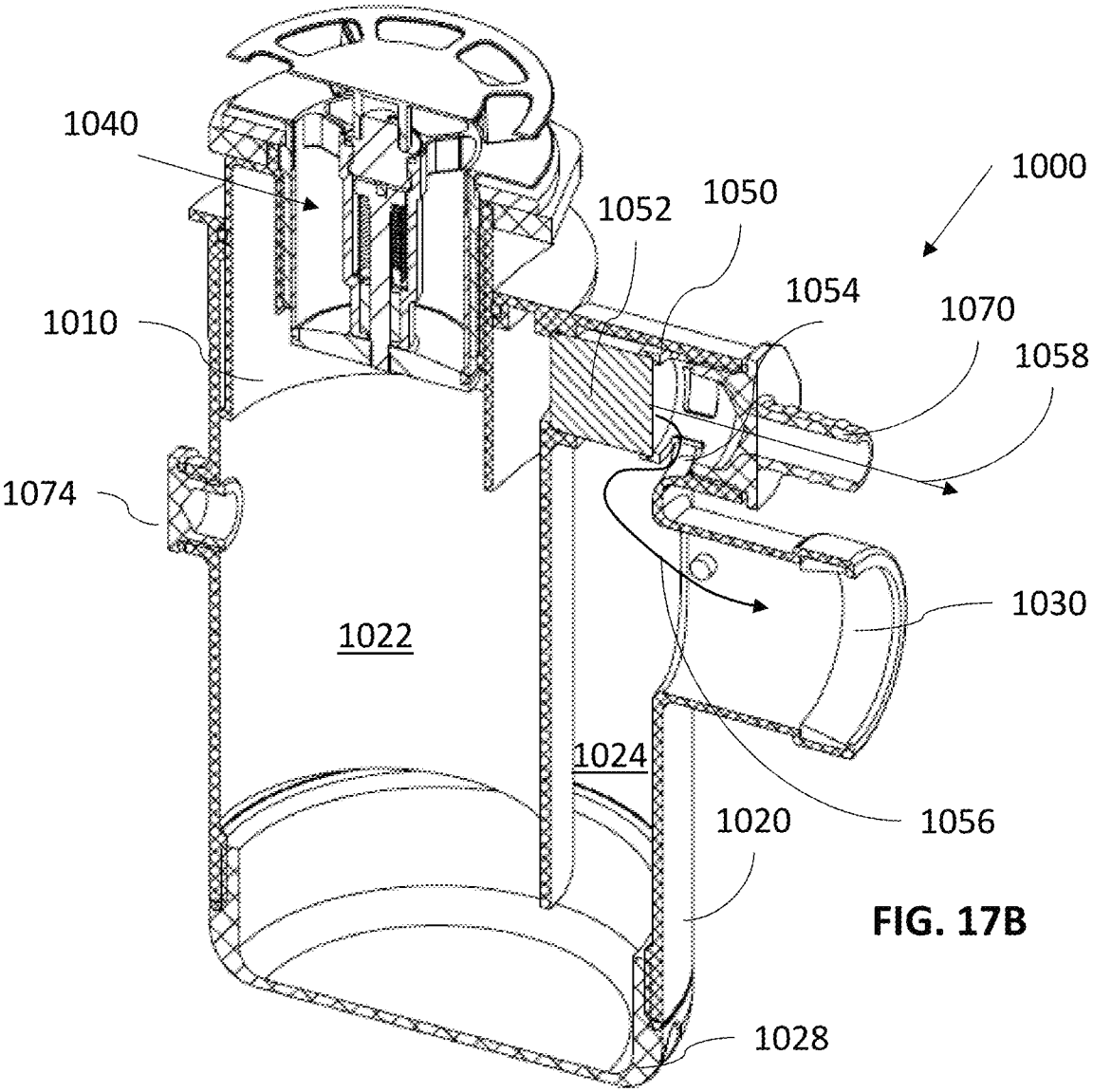

Reference is now made to FIGS. 17A and 17B which are, respectively, a planar side view illustration and a perspective sectional illustration of the drain pipe connector system 1000, including a connector nipple. As seen in FIGS. 17A and 17B, the cap 1060, which in FIGS. 14 to 16C closes off the second end of pressure equalizing element 1050, is replaced by a connector nipple 1070. In such embodiments, fluid flowing into pressure equalizing element 1050 may flow out of the pressure equalizing element via pathway 1054 as described above and as indicated by arrow 1056, and/or via nipple 1070 as indicated by arrow 1058.

In some embodiments, a biological filter, a chemical filter, or any other filter for contaminants which may flow into linear pipe segment 1010 or out of drain trap 1020 may be attached to connector nipple 1070, such that air flowing out of pressure equalizing element 1050 via connector nipple 1070 is filtered. In such embodiments, there is no fear that contaminants will be released into the environment surrounding an exterior of system 1000, and there is no necessity to further process or handle air released from connector nipple 1070 and the filter thereof.

In some embodiments, drain trap 1020 of any one of FIGS. 14 to 17B may be integrally formed with a port 1074, or with a second connector nipple, which may be sealed by a sealing cover. Port or connector 1074 may be used for connection of a biofilm treatment device and/or a liquid treatment device, as described hereinabove with respect to FIGS. 9 to 13.

Figure 18A:
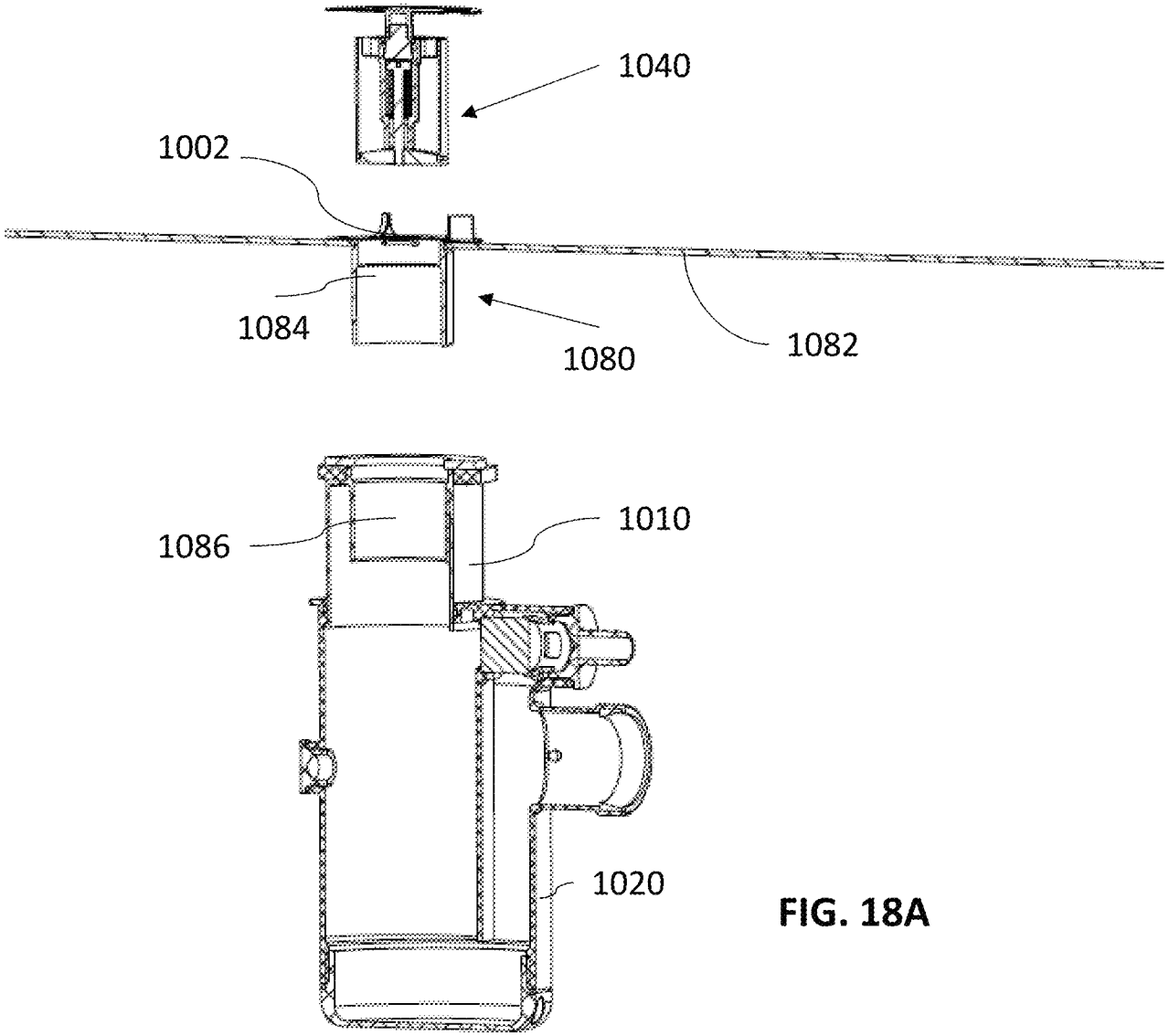
FIGS. 18A and 18B are perspective sectional illustrations of the drain pipe connector system of FIGS. 17A and 17B, during stages of installation thereof.
Figure 18B:
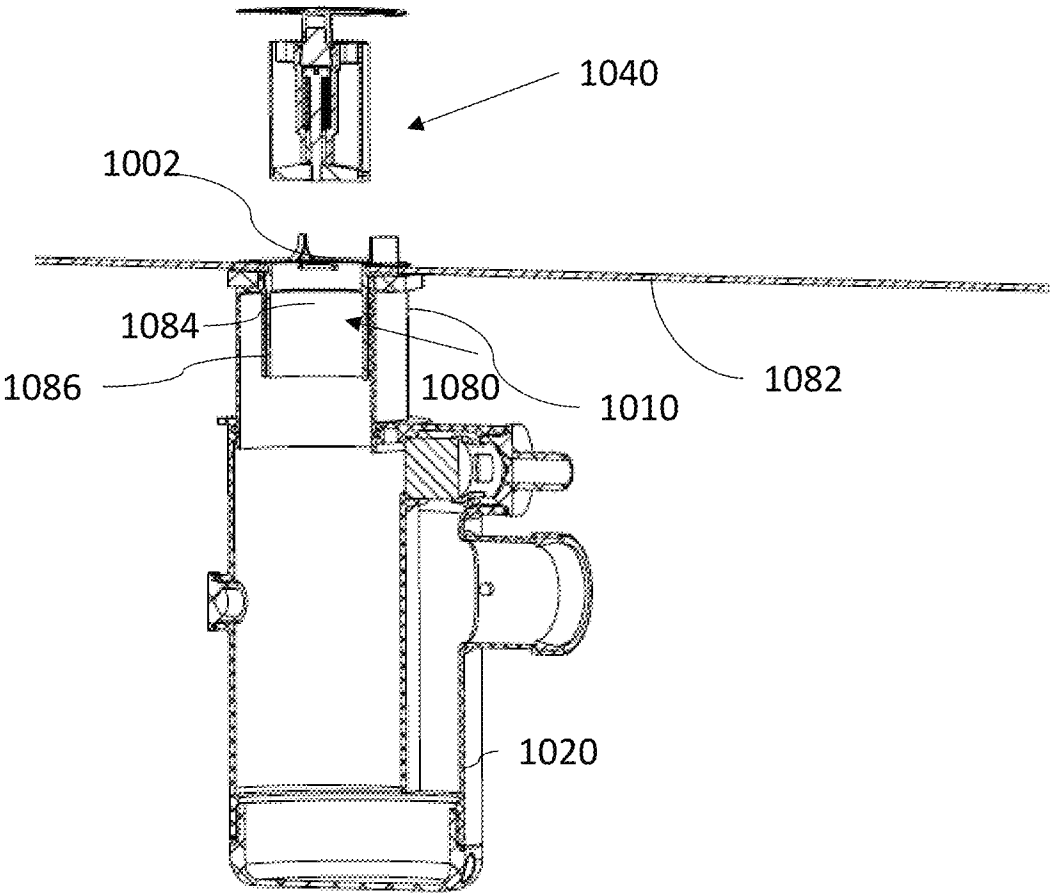

Reference is now made to FIGS. 18A and 18B, which are perspective sectional illustrations of the drain pipe connector system 1000 of FIGS. 17A and 17B, during stages of installation thereof. In order to enable easy cleaning and/or replacement of the unidirectional valve 1040, the system 1000 includes an additional adapter 1080, which interfaces between unidirectional valve 1040 and the linear pipe segment 1010.

As seen specifically in FIG. 18A, when initiating installation, unidirectional valve 1040 is separate from linear pipe segment 1010. Linear pipe segment 1010 is disposed within drain trap 1020 at the desired height therewithin. At this stage, adapter 1080 is attached to portal 1002 within a surface 1082 of the plumbing fixture, such that a tubular portion 1084 of the adapter extends beneath the surface. The unidirectional valve 1040 is disposed above the surface, and the linear pipe segment together with drain trap 1020 are disposed below the adapter.

Turning to FIG. 18B, it is seen that following installation of adapter 1080, linear pipe segment 1010 is attached to tubular portion 1084, thereby attaching the linear pipe segment, and the drain trap 1020, to the surface 1082 and to portal 1002. The attachment may be, for example, threaded attachment. In some embodiments, linear pipe 1010 includes an internal tubular portion 1086, which is similar in diameter to tubular portion 1084 and is attachable thereto.

Subsequently, unidirectional valve 1040 may be inserted into adapter 1080 and attached thereto, completing installation of the system 1000. The attachment may be, for example, threaded attachment.

It will be appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

The invention claimed is:

1. A drain system disposed between a drain portal of a plumbing fixture and a sewage system, the drain system comprising:

a drain pipe connector including:

a first unidirectional valve adapted to be in fluid communication with the drain portal; and a linear pipe segment downstream of said first unidirectional valve;

a drain trap disposed downstream to, and in fluid communication with, said linear pipe segment, and connected to a sewage pipe leading to the sewage system;

an additional connector nipple disposed in a wall of said drain pipe connector, said additional connector nipple being connectable to at least one of a biofilm treatment device and a liquid treatment device; and a pressure equalizing mechanism permitting flow of gas from a region of said drain pipe connector between said first unidirectional valve and a liquid level within said drain trap, to release super-atmospheric pressure from said region, wherein said first unidirectional valve has a closed operative orientation, in which said first unidirectional valve forms a seal between the plumbing fixture and said drain trap, and an open operative orientation which enables flow of fluid from the plumbing fixture, via said first unidirectional valve, into said drain trap, wherein said first unidirectional valve is normally closed, and when liquid drains into said first unidirectional valve, pressure applied by said liquid transitions said first unidirectional valve from said closed operative orientation to said open operative orientation, thereby enabling said liquid to flow into said drain trap.

2. The drain system of claim 1, further comprising a biofilm treatment device connected to said additional connector nipple, said biofilm treatment device including:

a processor;

at least one biofilm treatment unit controlled by said processor; and a power source providing power to said processor and said at least one biofilm treatment unit.

3. The drain system of claim 2, wherein said biofilm treatment device further comprises a housing accommodating said processor and said power source, and wherein said at least one biofilm treatment unit is disposed within said drain trap and is connected to said housing by at least one cable extending through said linear pipe segment and said additional connector nipple.

4. The drain system of claim 2, wherein said at least one biofilm treatment unit comprises a vibrator adapted to vibrate liquid within said drain trap so as to inhibit formation of biofilm and/or to break down existing biofilm.

5. The drain system of claim 2, wherein said at least one biofilm treatment unit comprises a liquid circulating pump, adapted to circulate liquid within said drain trap so as to inhibit formation of biofilm.

6. The drain system of claim 2, wherein said at least one biofilm treatment unit comprises a heating unit adapted to heat liquid within said drain trap so as to exterminate biological contaminants within said liquid in said drain trap.

7. The drain system of claim 2, wherein said at least one biofilm treatment unit comprises an ultra-violet light source adapted to illuminate liquid within said drain trap with ultra-violet light so as to exterminate biological contaminants within said liquid in said drain trap.

8. The drain system of claim 2, wherein said at least one biofilm treatment unit comprises a plurality of biofilm treatment units.

9. The drain system of claim 8, wherein said plurality of biofilm treatment units are disposed within said drain trap simultaneously.

10. The drain system of claim 8, wherein only one of said plurality of biofilm treatment units is disposed within said drain trap at any given time, and said biofilm treatment device is adapted for interchanging between different ones of said plurality of biofilm treatment units.

11. The drain system of claim 1, further comprising a liquid treatment device connected to said additional connector nipple, said liquid treatment device including:

a processor;

a motor controlled by said processor;

a treatment liquid pump controlled by said engine and associated with a treatment liquid reservoir; and a power source adapted to provide power to said processor, said motor, and said treatment liquid pump, wherein said liquid treatment device is adapted to pump treatment liquid from said treatment liquid reservoir into said drain trap to treat liquid disposed therein.

12. A kit for installation in a drain system disposed between a drain portal of a plumbing fixture and a sewage system, the kit comprising:

a drain pipe connector including:

a first unidirectional valve including a valve hollow, adapted to be in fluid communication with the drain portal, and a valve seal; and a linear pipe segment connected to said first unidirectional valve; and a drain trap connectable to the drain pipe connector and to the sewage system, the drain trap having a pressure equalizing mechanism integrated therewith, said pressure equalizing mechanism including a pressure equalizing conduit having a first end and a second end and being adapted to allow fluid flow from said first end toward said second end; and at least one of:

a cap for sealing said second end of said pressure equalizing conduit, such that, when the kit is assembled, fluid flowing from said first end toward said second end is directed to the sewage system;

a first connector nipple disposed within or connectable to a wall of said drain pipe connector, said drain trap, or said pressure equalizing mechanism and having a first end and a second end, said first end being in fluid communication with said linear pipe segment and said second end being in fluid communication with an external environment of said drain pipe connector or of said drain trap; and an additional connector nipple disposed in a wall of said drain pipe connector, said additional connector nipple being connectable to at least one of a biofilm treatment device and a liquid treatment device, wherein said first unidirectional valve has a closed operative orientation, in which said valve seal separates said valve hollow from said linear pipe segment, and an open operative orientation which enables flow of fluid from said valve hollow, into said linear pipe segment, wherein said first unidirectional valve is adapted to be normally closed, and is adapted so that, when liquid drains into said valve hollow, pressure applied by said liquid is adapted to transition said first unidirectional valve from said closed operative orientation to said open operative orientation, thereby to enable said liquid to flow into said linear pipe segment.

13. The kit of claim 12, further comprising a biofilm treatment device, connectable, or being connected to, said additional connector nipple, said biofilm treatment device including:

a processor;

at least one biofilm treatment unit controlled by said processor; and a power source providing power to said processor and said at least one biofilm treatment unit.

14. The kit of claim 13, wherein said biofilm treatment device further comprises a housing accommodating said processor and said power source, and wherein said at least one biofilm treatment unit is adapted disposed within the drain trap and is adapted to be connected to said housing by at least one cable adapted to extend through said linear pipe segment and said additional connector nipple.

15. The kit of claim 13, wherein said at least one biofilm treatment unit comprises at least one of:

a vibrator adapted to vibrate liquid within the drain trap;

a liquid circulating pump, adapted to circulate liquid within the drain trap;

a heating unit adapted to heat liquid within the drain trap; and an ultra-violet light source adapted to illuminate liquid within the drain trap with ultra-violet light.

16. The kit of claim 13, wherein said at least one biofilm treatment unit comprises a plurality of biofilm treatment units.

17. The kit of claim 16, wherein at least two of said plurality of biofilm treatment units are adapted to be simultaneously connected to said housing.

18. The kit of claim 16, wherein said housing is adapted to be connected to a single one of said plurality of biofilm treatment units at any given time, and is adapted for interchangeable connection to said plurality of biofilm treatment units.

19. The kit of claim 12, further comprising a liquid treatment device connected to said additional connector nipple, said liquid treatment device including:

a processor;

a motor controlled by said processor;

a treatment liquid pump controlled by said engine and associated with a treatment liquid reservoir; and a power source adapted to provide power to said processor, said motor, and said treatment liquid pump, wherein said liquid treatment device is adapted to pump treatment liquid from said treatment liquid reservoir into the drain trap to treat liquid disposed therein.

20. A method of retrofitting a drain system to reduce or prevent release of biological contaminants therefrom, the drain system being disposed between a drain portal of a plumbing fixture and a sewage system and including a drain trap, the method comprising:

removing a portion of the drain system disposed between the drain portal of the plumbing fixture and the drain trap;

installing the drain pipe connector of the kit of claim 12, such that said hollow of said unidirectional valve is disposed within the drain portal and is in fluid communication with the plumbing fixture, and said first linear pipe segment is inserted into, or connected to, a first end of the drain trap, upstream of a liquid accumulation therein, wherein said biological filter is adapted to filter gas removed from said drain pipe connector via said first connector nipple, thereby to relieve pressure from said drain pipe connector while preventing contamination of said external environment.

* * * * *